US010641538B1

(12) United States Patent
Tang et al.

(10) Patent No.: US 10,641,538 B1
(45) Date of Patent: May 5, 2020

(54) PORTABLE REFRIGERATOR WITH RECHARGEABLE BATTERY PACK

(71) Applicant: ACOSOLAR INC., Walnut, CA (US)

(72) Inventors: Longhua Tang, Walnut, CA (US); Zhizhong Zhang, Nanjing (CN)

( * ) Notice: Subject to any disclaimer, the term of this patent is extended or adjusted under 35 U.S.C. 154(b) by 0 days.

(21) Appl. No.: 16/447,623

(22) Filed: Jun. 20, 2019

(30) Foreign Application Priority Data

| | | |
|---|---|---|
| Oct. 26, 2018 | (CN) | 2018 2 1740385 U |
| Nov. 26, 2018 | (CN) | 2018 2 1950528 U |
| Dec. 24, 2018 | (CN) | 2018 2 2171825 U |
| May 27, 2019 | (CN) | 2019 2 0766615 U |

(51) Int. Cl.

| | |
|---|---|
| ***F25D 19/00*** | (2006.01) |
| ***F25D 11/00*** | (2006.01) |
| ***F25D 23/02*** | (2006.01) |
| ***F25D 23/06*** | (2006.01) |
| ***F25B 27/00*** | (2006.01) |

(52) U.S. Cl.
CPC ..... *F25D 19/003* (2013.01); *F25B 27/00* (2013.01); *F25D 23/02* (2013.01); *F25D 23/06* (2013.01); *F25D 2331/804* (2013.01); *F25D 2400/12* (2013.01); *F25D 2400/38* (2013.01)

(58) Field of Classification Search
CPC .. F25D 11/003; F25D 19/003; F25D 2400/12; F25D 2400/38
See application file for complete search history.

(56) References Cited

U.S. PATENT DOCUMENTS

| | | | | |
|---|---|---|---|---|
| 6,870,089 | B1 | 3/2005 | Gray | |
| 7,481,070 | B2 | 1/2009 | Costanzo | |
| 8,353,167 | B2 | 1/2013 | McGann | |
| 2007/0193297 | A1* | 8/2007 | Wilson | F25D 29/00 62/371 |
| 2009/0158770 | A1* | 6/2009 | Cohrs | F25D 23/12 62/457.9 |
| 2014/0295257 | A1* | 10/2014 | Harada | H01M 2/1055 429/179 |
| 2016/0003505 | A1 | 1/2016 | Trotter | |
| 2017/0119116 | A1* | 5/2017 | Bradley | A45C 7/004 |
| 2017/0259956 | A1* | 9/2017 | Hori | A45C 7/0045 |
| 2017/0370629 | A1 | 12/2017 | Fire | |

* cited by examiner

*Primary Examiner* — Henry T Crenshaw
*Assistant Examiner* — Daniel C Comings
(74) *Attorney, Agent, or Firm* — Tsz Lung Yeung

(57) ABSTRACT

A portable refrigerator includes a main housing, a refrigerator cover, a cooling mechanism, a rechargeable battery pack and a control unit. The cooling mechanism includes heat exchanging tubes, a compressor, an evaporator and a condenser connected to the evaporator and the compressor. The rechargeable battery pack is detachably attached on a power compartment of the main housing. The control unit is supported in the main housing and electrically connected to the rechargeable battery pack and the cooling mechanism for centrally controlling an operation of the cooling mechanism. A predetermined amount of refrigerant is arranged to controllably pass through the heat exchanging tubes, the condenser, the evaporator and the compressor for extracting heat from the accommodating cavity.

3 Claims, 26 Drawing Sheets

PORTABLE REFRIGERATOR WITH RECHARGEABLE BATTERY PACK

BACKGROUND OF THE PRESENT INVENTION

Field of Invention

The present invention relates to a refrigerator, and more particularly to a portable refrigerator comprising a rechargeable battery pack which many be detachable from a main housing and may be recharged through a conventional AC power source, a detachable solar panel, a car power output, and any DC power supply.

Description of Related Arts

Portable refrigerators have widely been utilized around the world. A conventional portable refrigerator may utilize a compressor for actuating heat exchange between a storage compartment and ambient environment.

A major disadvantage of conventional portable refrigerators relates to acquiring power for maintaining heat exchange processes which take place in various components of the portable refrigerators. Conventionally, a majority of portable refrigerators is electrically connected to a power port provided in a car. An obvious problem for this arrangement is that when the portable refrigerator is operating, the car must also be started to allow continuous supply of electrical power from the power port of the car.

Some conventional portable refrigerators utilize solar panels to collect solar energy and store the solar energy in a rechargeable battery embedded in the corresponding portable refrigerator. A problem with this type of portable refrigerators is that the rechargeable batteries cannot be taken out from the refrigerators. Moreover, the rechargeable batteries may or may not be charged by other means, such as connecting the portable refrigerators to a wall power supply. Even if the portable refrigerator can be connected to a wall power supply, it would be very inconvenience for a user to do so.

SUMMARY OF THE PRESENT INVENTION

Certain variations of the present invention provide a portable refrigerator comprising a rechargeable battery pack which many be detachable from a main housing and may be recharged through a conventional AC power source or by a detachable solar panel.

Certain variations of the present invention provide a portable refrigerator in which various components of the portable refrigerator can be centrally controlled by a central control unit.

Certain variations of the present invention provide a portable refrigerator in which the central control unit is arranged to utilize uninterruptible power supply (UPS) so that it provides near-instantaneous protection from input power interruptions to the compressor and other components of a cooling mechanism.

In one aspect of the present invention, it provides a portable refrigerator, comprising:

a main housing having an accommodating cavity for storing at least one item, and a power compartment;

a refrigerator cover provided on the main housing for selectively closing the accommodating cavity;

a cooling mechanism which is supported by the main housing and comprises a plurality of heat exchanging tubes, a compressor, an evaporator connected to the compressor through at least one of the heat exchanging tubes, and a condenser connected to the evaporator and the compressor through at least one of the heat exchanging tubes;

a rechargeable battery pack detachably attached on the power compartment of the main housing, the rechargeable battery being adapted for connecting to a power source; and a central control unit supported in the main housing and electrically connected to the rechargeable battery pack and the cooling mechanism for centrally controlling an operation of the cooling mechanism, wherein a predetermined amount of refrigerant is arranged to controllably pass through the heat exchanging tubes, the condenser, the evaporator and the compressor for extracting heat from the accommodating cavity.

This summary presented above is provided merely to introduce certain concepts and not to identify any key or essential features of the claimed subject matter.

DETAILED DESCRIPTION OF THE PREFERRED EMBODIMENT

Figure 1:
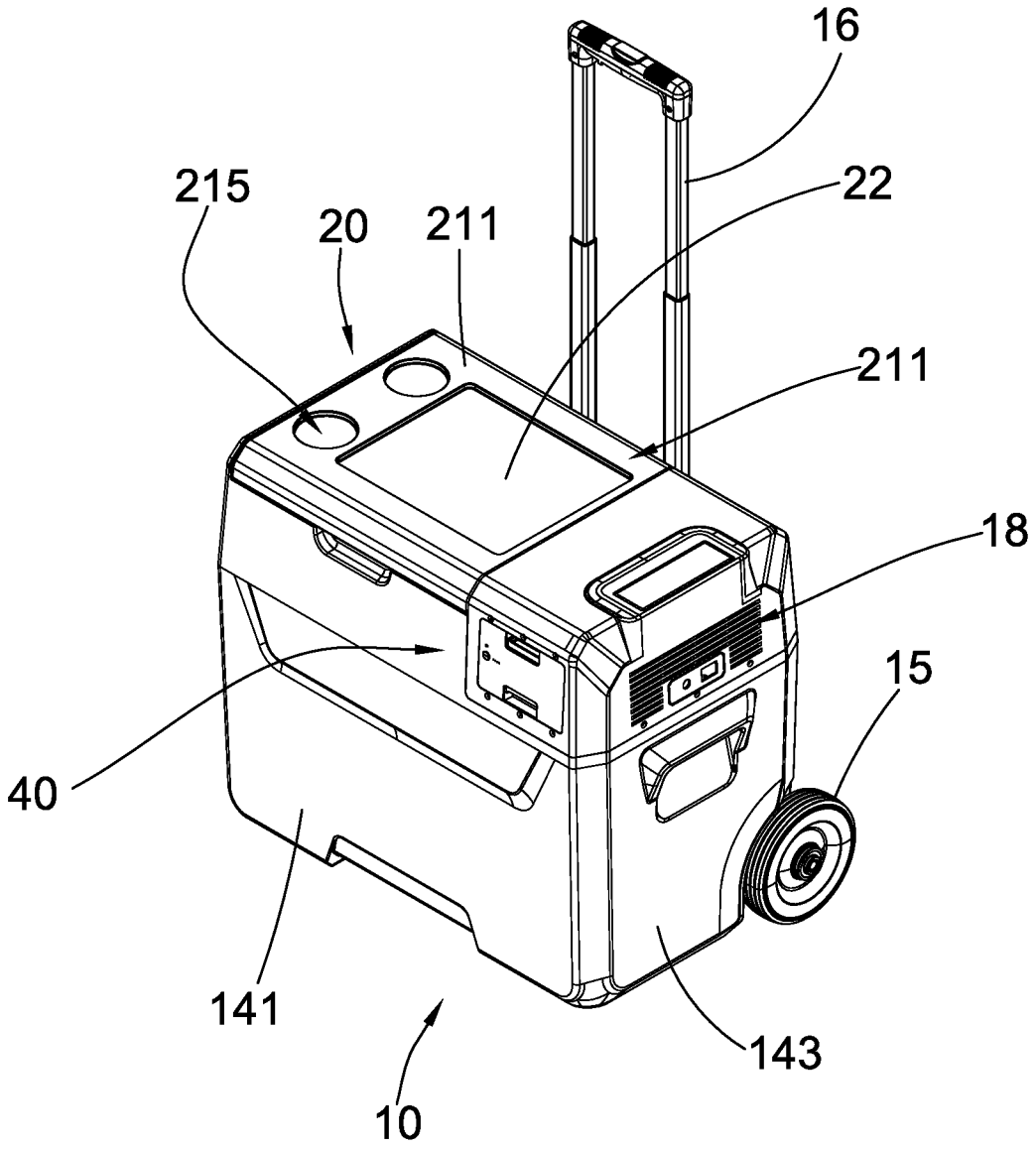
FIG. 1 is a front perspective view of a portable refrigerator according to a preferred embodiment of the present invention.
Figure 2:
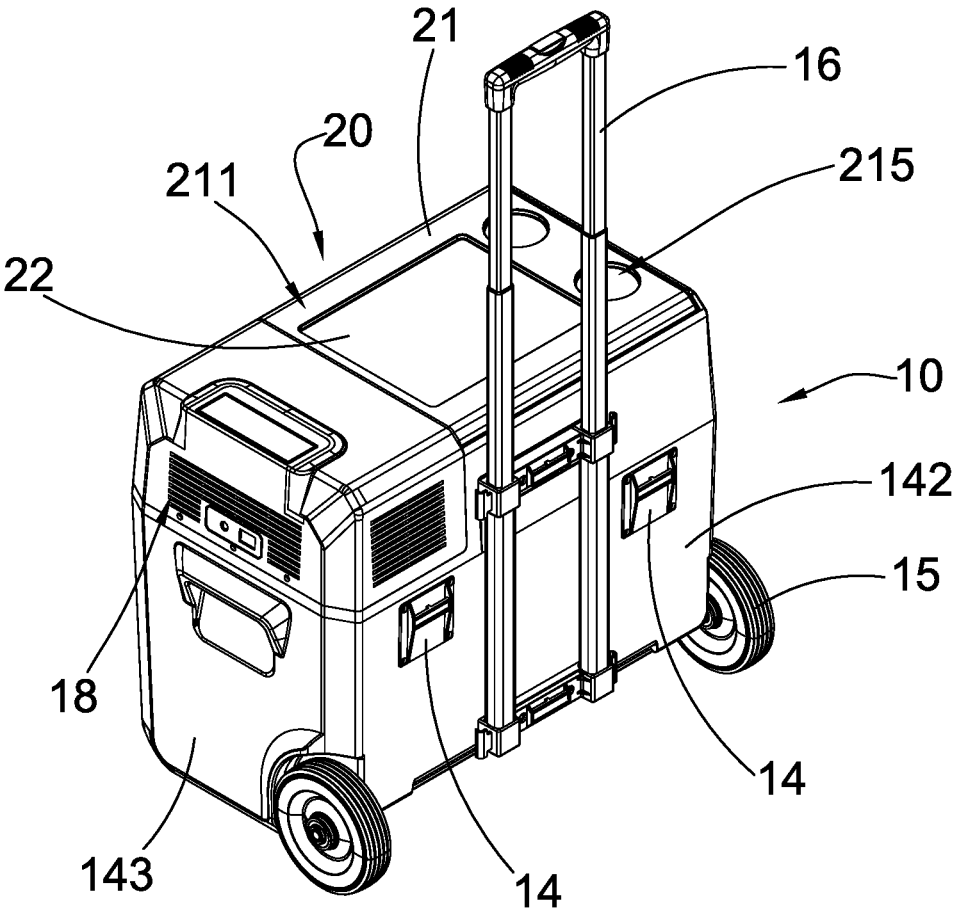
FIG. 2 is a rear perspective view of the portable refrigerator according to the preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIGS. 1 to 18, FIG. 19A to FIG. 19E and FIG. 20A to FIG. 20H of the drawings, a portable refrigerator according to a preferred embodiment of the present invention is illustrated. Broadly, the portable refrigerator may comprise a main housing 10, a refrigerator cover 20, a cooling mechanism 30, a rechargeable battery pack 40, and a central control unit 50.

The main housing 10 has an accommodating cavity 11 for storing at least one item, and a power compartment 12. The refrigerator cover 20 may be provided on the main housing 10 for selectively closing the accommodating cavity 11.

The cooling mechanism 30 may be supported by the main housing 10 and comprises a plurality of heat exchanging tubes 31, a compressor 32, an evaporator 33 connected to the compressor 32 through at least one of the heat exchanging tubes 31, and a condenser 34 connected to the evaporator 33 and the compressor 32 through at least one of the heat exchanging tubes 31.

The rechargeable battery pack 40 may be detachably attached on the power compartment 12 of the main housing 10. Moreover, the rechargeable battery pack may be adapted for connecting to a power source.

The central control unit 50 may be supported in the main housing 10 and electrically connected to the rechargeable battery pack 40 and the cooling mechanism 30 for centrally controlling an operation of the cooling mechanism 30, wherein a predetermined amount of refrigerant is arranged to controllably pass through the heat exchanging tubes 31, the condenser 34, the evaporator 33 and the compressor 31 for extracting heat from the accommodating cavity 11.

According to the preferred embodiment of the present invention, the portable refrigerator may be utilized in outdoor environment as a self-contained unit. The main housing 10 may comprise a front wall 141, a rear wall 142, and two side walls 143, wherein the accommodating cavity 11 may be formed as a space between a space surrounded by the front wall 141, the rear wall 142 and the side walls 143. The main housing 10 may further have an access opening 17 formed on a top side thereof as a top opening of the accommodating cavity 11. Thus, the accommodating cavity 11 may communicate with an exterior of the main housing 10 through the access opening 17.

The main housing 10 may further comprise a first side peripheral rim 103, a second side peripheral rim 104 and a rear peripheral rim 105 upwardly extended from an outer surface of the two side walls 143 and the rear wall 142 respectively for connecting to the refrigerator cover 20 (described in more details below). The access opening 17 may therefore be formed at a position below the first side peripheral rim 103, the second side peripheral rim 104 and the rear peripheral rim 105. Moreover, a cover seat 106 may be formed as the space on top of the two side walls 143, the rear wall 142 and the front wall 141 and surrounded by the first side peripheral rim 103, the second side peripheral rim 104 and the rear peripheral rim 105.

The main housing 10 may further have a components compartment 13 formed adjacent to the accommodating cavity 11 for storing various mechanical and electrical components of the portable refrigerator.

The main housing 10 may further comprise a plurality of wheels 15 rotatably provided on two side walls 143 respectively for facilitating easy transportation of the portable refrigerator. Moreover, the main housing 10 may further comprise a retractable handle 16 provided on the rear wall 142 so that a user may utilize the retractable handle 16 to carry the portable refrigerator. The main housing 10 may further comprise a plurality of hanging members 14 formed on the rear wall 142 for allowing an external objects to be hung thereon. Furthermore, the main housing 10 may further comprise an anchoring member 140 formed on a bottom wall 144 of the main housing 10 so that a user may tie an external object on the main housing by using the anchoring member 140.

The refrigerator cover 20 may be detachably attached on the main housing 10 to selectively close the access opening 17. Specifically, the refrigerator cover 20 may comprise a cover body 21 having a top surface 211, a bottom surface 212, a first side surface 213 and a second side surface 214. The cover body 21 may have a plurality of (but at least one) indentions 215 formed on the top surface 211 for holding cups or other beverage containers. In this preferred embodiment, there may be three indentions 215, two of which may have a circular cross section when viewed from the top while the remaining indention 215 may have a rectangular cross section also when viewed from the top.

Moreover, the refrigerator cover 20 may further comprise a frictional member 22 provided on one of the indentions 215 of the cover body 21, wherein the frictional member 22 may be configured to have a greater frictional force than other parts of the refrigerator cover 20 so that when external items, such as tablet computers, are disposed on the frictional member 22, the external items may be retained on the frictional member 22.

The refrigerator cover 20 may further comprise a first connecting member 23 and the second connecting member 24 extended from the first side surface 213 and the second side surface 214 of the cover body 21 respectively for pivotally and detachably connecting to the main housing 10. Specifically, the first connecting member 23 may be outwardly extended from the first side surface 213 and may be configured as having a cylindrical shape (i.e. circular cross-sectional shape) for pivotally connecting to the main housing 10. On the other hand, the second connecting member 24 may have a quadrilateral or rectangular cross-sectional shape and may be outwardly extended from the second side surface 214.

Figure 4:
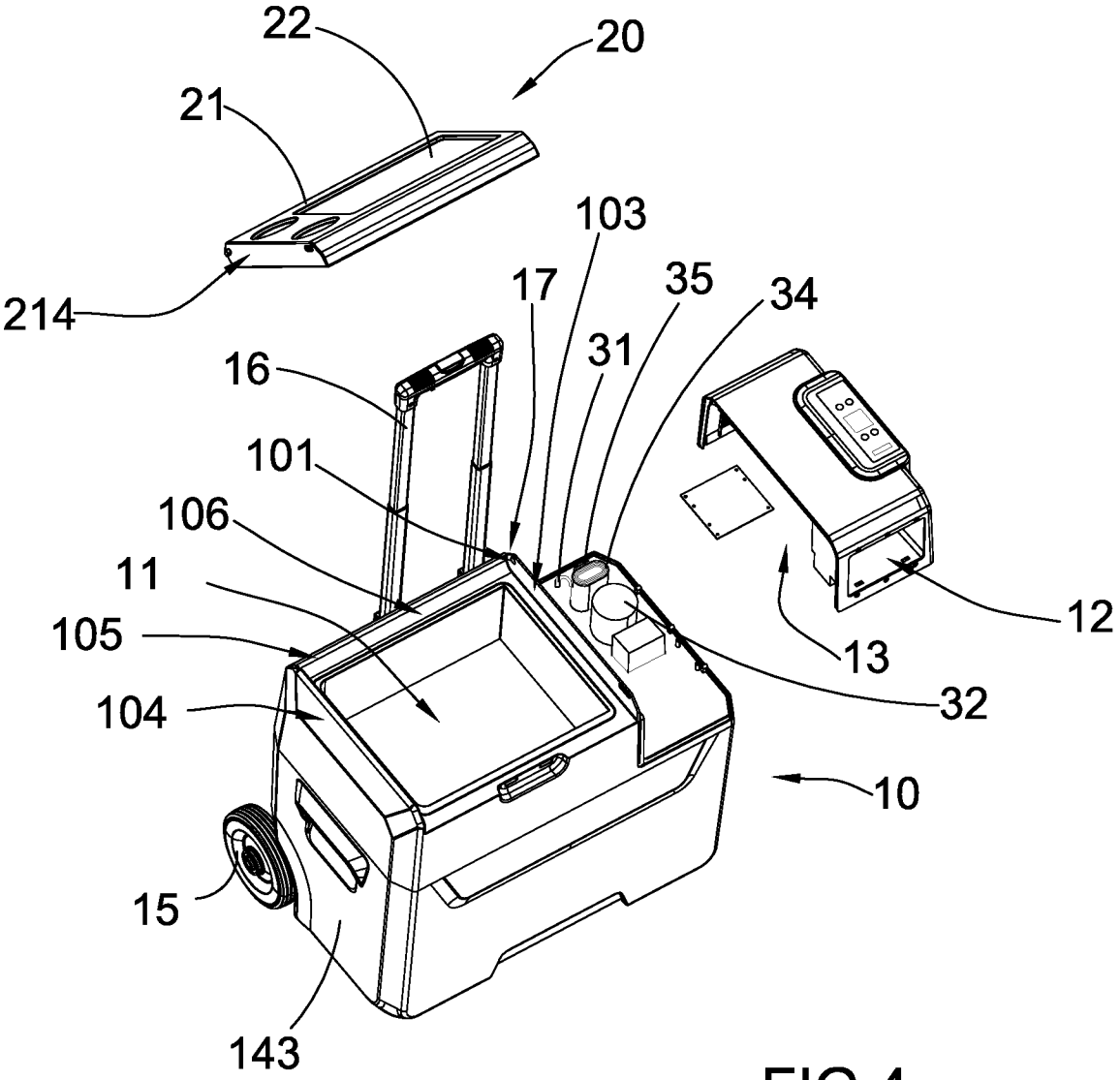
FIG. 4 is an exploded perspective view of the portable refrigerator according to the preferred embodiment of the present invention.
Figure 5:
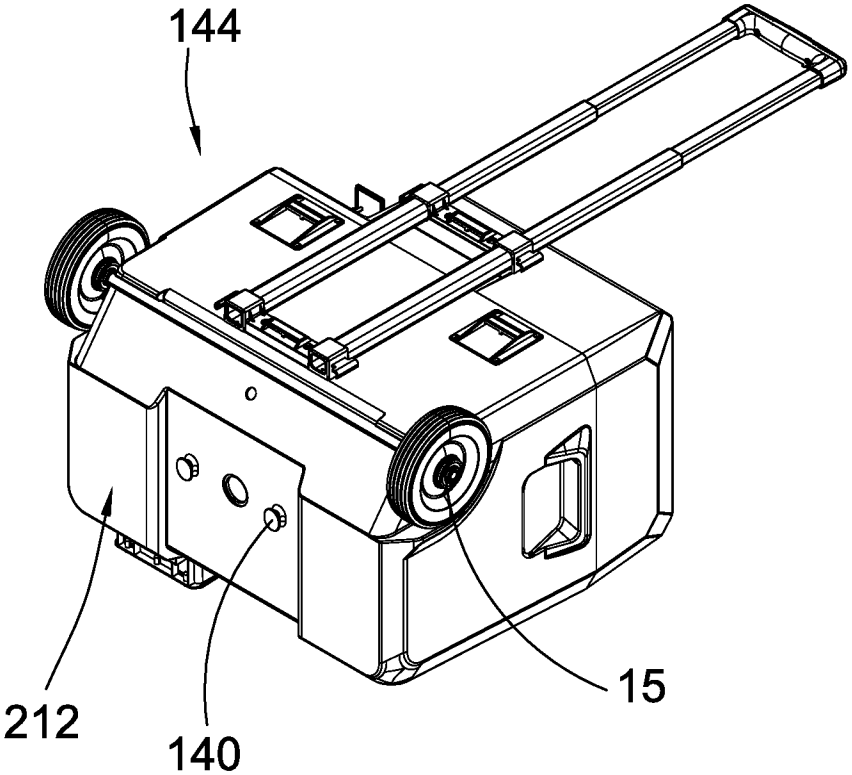
FIG. 5 is a schematic diagram of a bottom wall of a main housing of the portable refrigerator according to the preferred embodiment of the present invention.
Figure 6:
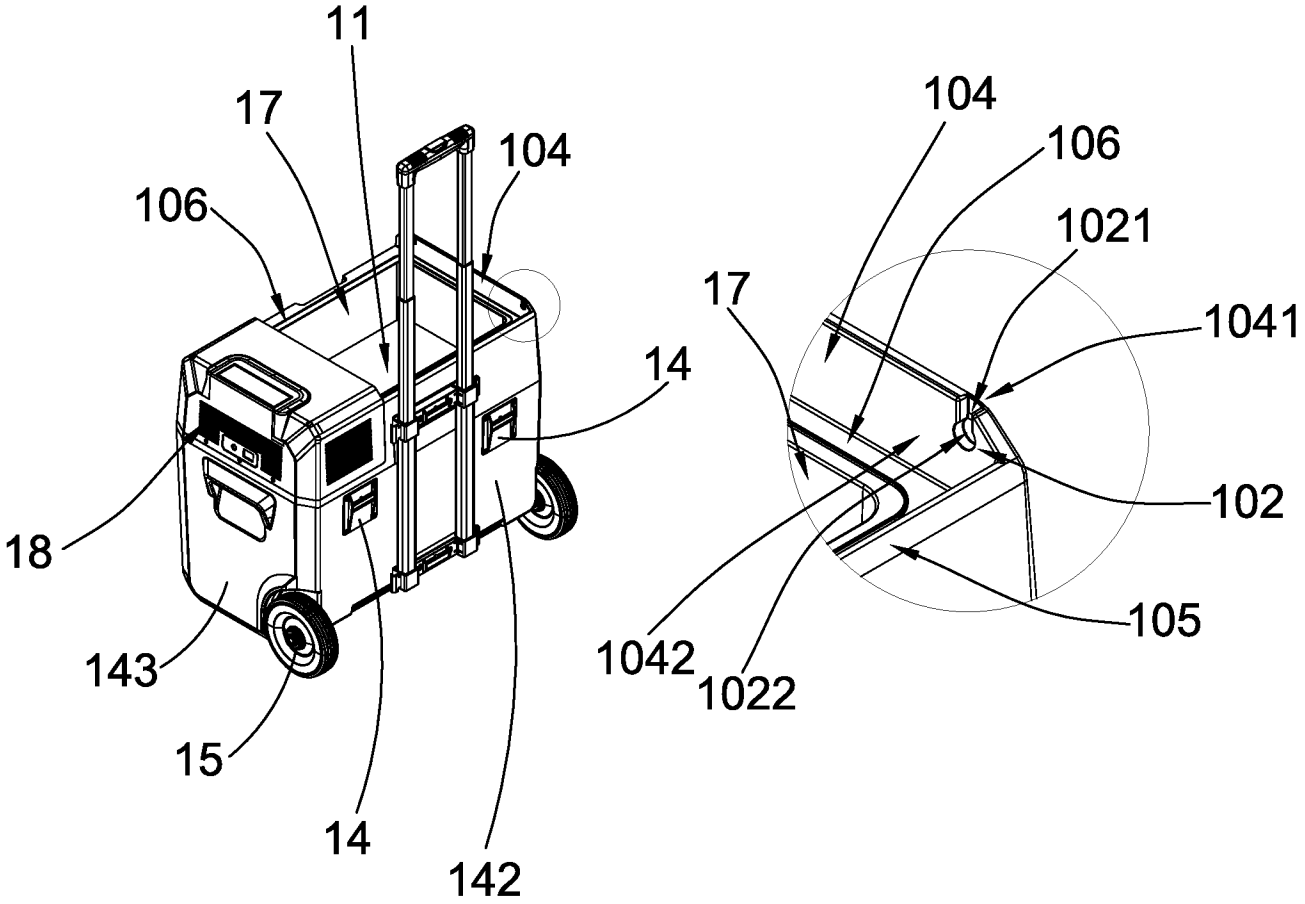
FIG. 6 is a schematic diagram of the portable refrigerator according to the preferred embodiment of the present invention, illustrating connection between a refrigerator cover and a main housing.
Figure 7:
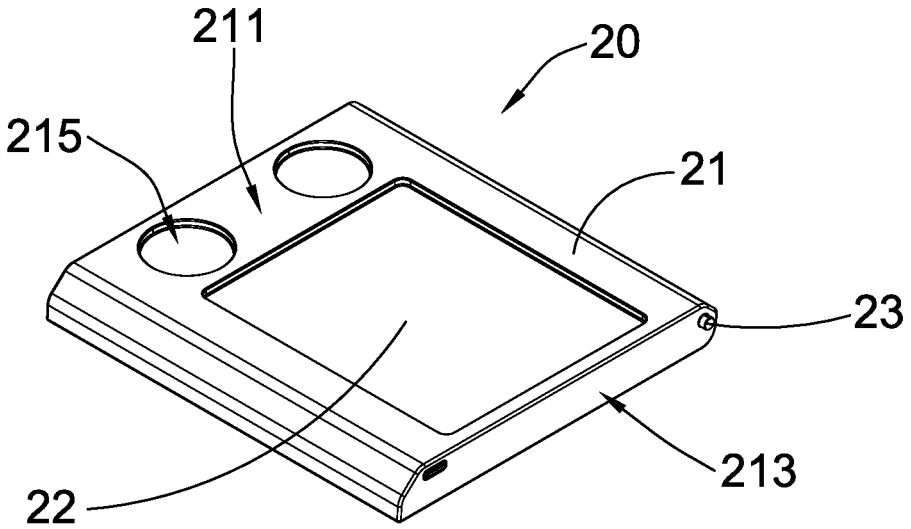
FIG. 7 is a perspective view of the refrigerator cover according to the preferred embodiment of the present invention.
Figure 8:
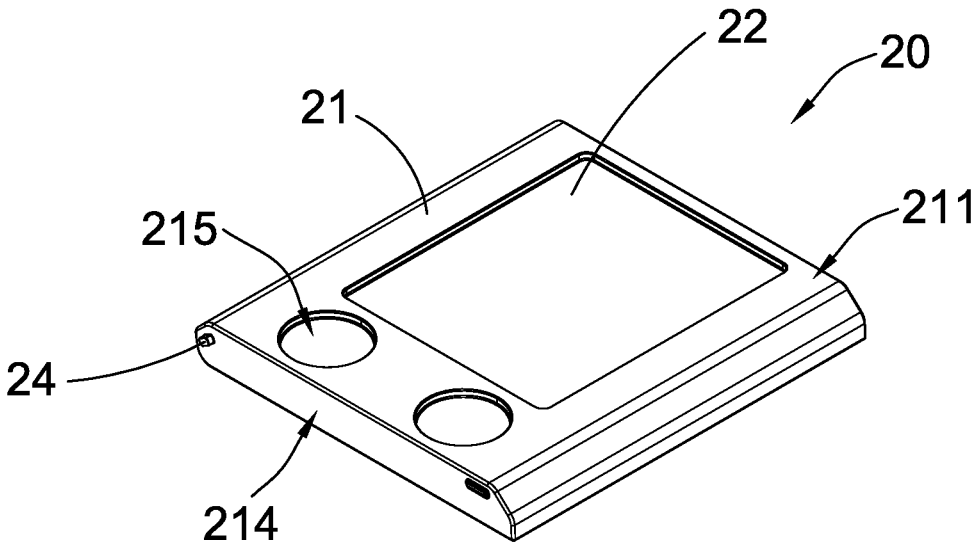
FIG. 8 is another perspective view of the refrigerator cover according to the preferred embodiment of the present invention.
Figure 9:
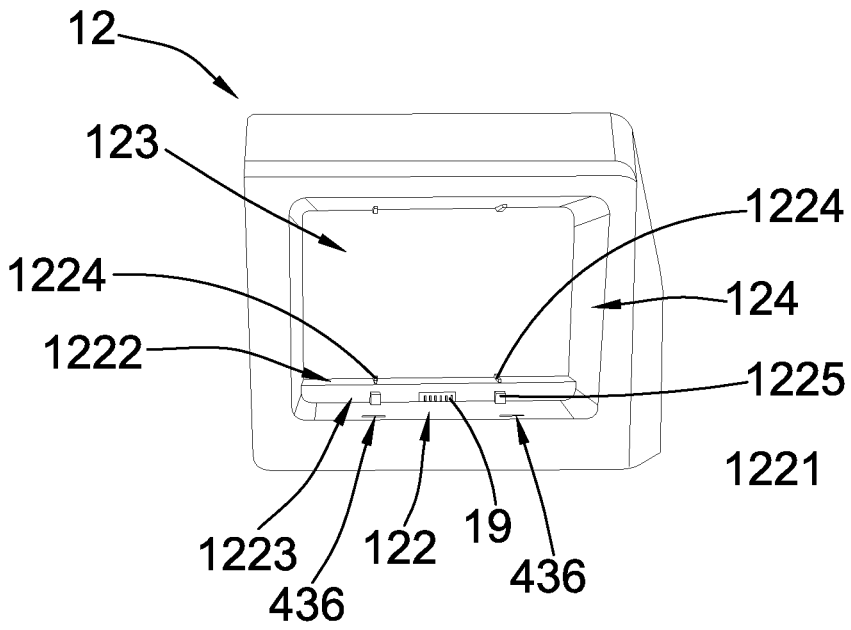
FIG. 9 is a perspective view of a power compartment of the portable refrigerator according to the preferred embodiment of the present invention, illustrating a bottom portion of the power compartment.
Figure 10:
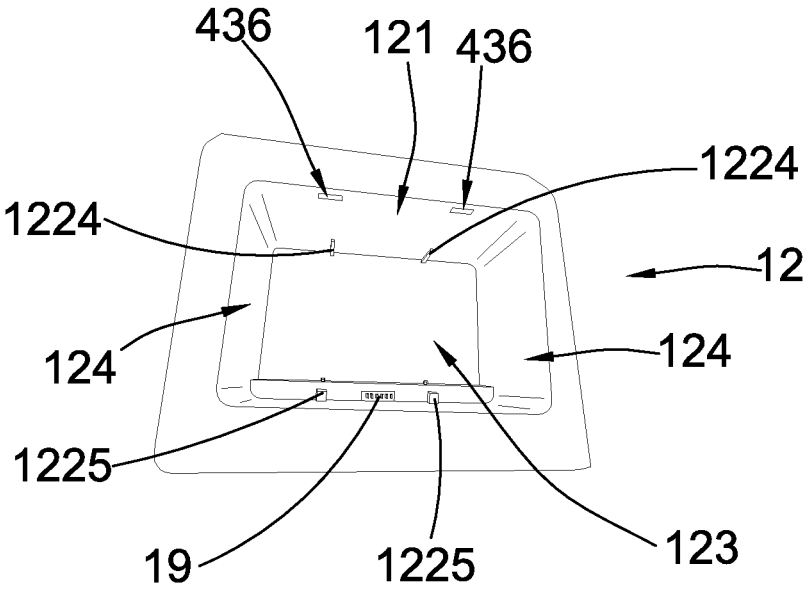
FIG. 10 is a perspective view of the power compartment of the portable refrigerator according to the preferred embodiment of the present invention, illustrating a lower portion of the power compartment.
Figure 11:
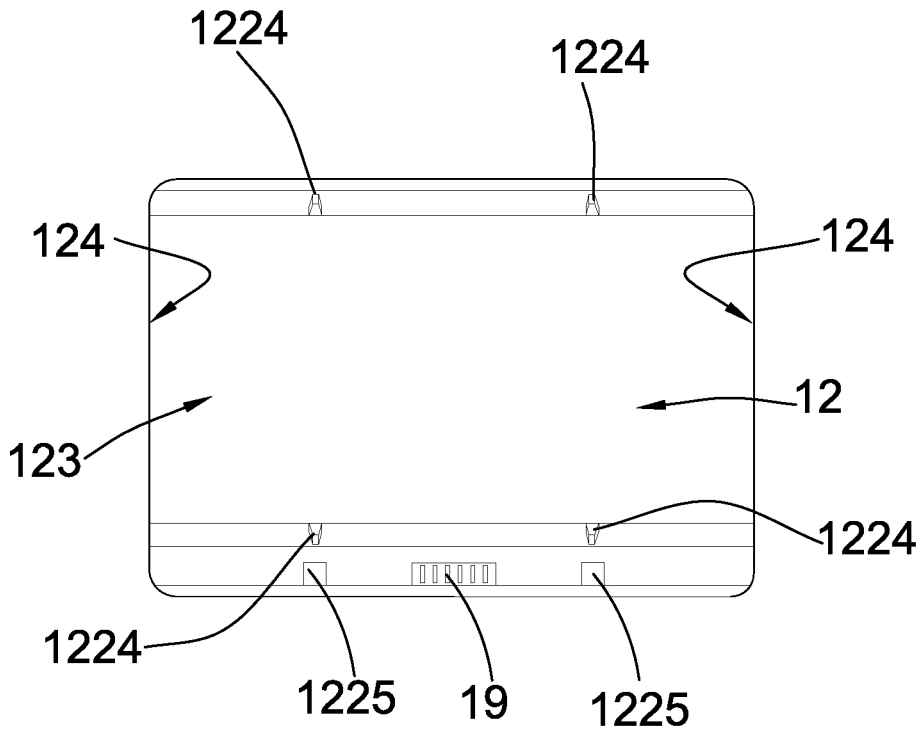
FIG. 11 is a front view of the power compartment of the portable refrigerator according to the preferred embodiment of the present invention.

Referring to FIG. 4 and FIG. 6 of the drawings, the main housing 10 may further has a first pivotal slot 101 and a second pivotal slot 102 formed on the first side peripheral rim 103 and the second side peripheral rim 104 respectively, wherein the first connecting member 23 and the second connecting member 24 may be arranged to pivotally and detachably connect to the first pivotal slot 101 and the second pivotal slot 102 respectively.

The first pivotal slot 101 may be shaped and sized to correspond to a cross sectional shape of the first connecting member 23 so that when the first connecting member 23 is inserted into the first pivotal slot 101, the first connecting member 23 may freely rotate about a longitudinal axis of the first pivotal slot 101. Thus, when the first connecting member 23 is configured as having a cylindrical cross section, the first pivotal slot 101 may also be configured as such.

On the other hand, the second pivotal slot 102 may be inclinedly extended from a top surface of the second side peripheral rim 104 so as to form a top opening 1041 on the second side peripheral rim 104 as the top end of the second pivotal slot 102. The second pivotal slot 102 may downwardly and inclinedly extend from the top opening 1041 along an inner side surface 1042 of the second side peripheral rim 104. The second pivotal slot 102 may have an enlarged portion 1021 and a contracted extension portion 1022 extended between the enlarged portion 1021 and the top opening 1041, wherein the second connecting member 24 may be arranged pivotally move in the enlarged portion 1021 and to slide along the contraction extension portion 1022 only when the second connecting member 24 aligns with the contracted extension portion 1022.

As shown in FIG. 6 of the drawings, when the second connecting member 24 is inserted into the enlarged portion 1021 of the second pivotal slot 102, the second connecting member 24 may rotate about a longitudinal axis of the enlarged portion 1021 of the second pivotal slot 102. Since a width of the contracted extension portion 1022 is smaller than that of the enlarged portion 1021, when the second connecting member 24 is in the enlarged portion 1021, the second connecting member 24 may normally be prevented from sliding along the contracted extension portion 1022. However, when the second connecting member 24 is in the enlarged portion 1021 and aligns with the contracted extension portion 1022, the second connecting member 24 may slide along the contracted extension portion 1022 and detach from the second side peripheral rim 104 through the top opening 1041.

This arrangement ensures that the refrigerator cover 20 may only detach from the main housing 10 when the refrigerator cover 20 is pivotally moved to a predetermined angle of inclination with respect to the main housing 10. This angle of inclination is the angle of inclination of the contracted extension portion 1022 forming on the second side peripheral rim 104.

The cooling mechanism 30 may comprise the compressor 32, the evaporator 33 and the condenser 34. They may be connected by the heat exchanging tubes 31. The compressor 32 and the condenser 34 may be positioned in the components compartment 13 of the main housing 10. A predetermined amount of refrigerant may flow through the heat exchanging tubes 31 for performing heat exchange with another physical medium so as to extract heat from the accommodating cavity 11.

The cooling mechanism 30 may further comprise a fan 35 provided in the components compartment 13 while the main housing 10 may further have a plurality of ventilating slots 18 which communicate the components compartment 13 with an exterior of the main housing 10. As such, the fan 35 may be driven to draw air into the components compartment 13 through the ventilating slots 18. Ambient air having lower temperature may be used to cool down the refrigerant which flows through the condenser 34 and carries heat from the accommodating cavity 11. The fan 35 may be mounted adjacent to the condenser 34 for effectively remove heat from the refrigerant flowing through the condenser 34. The fan 35 may also be electrically connected to the central control unit 50 so that it may also be centrally connected by the central control unit.

Figure 3:
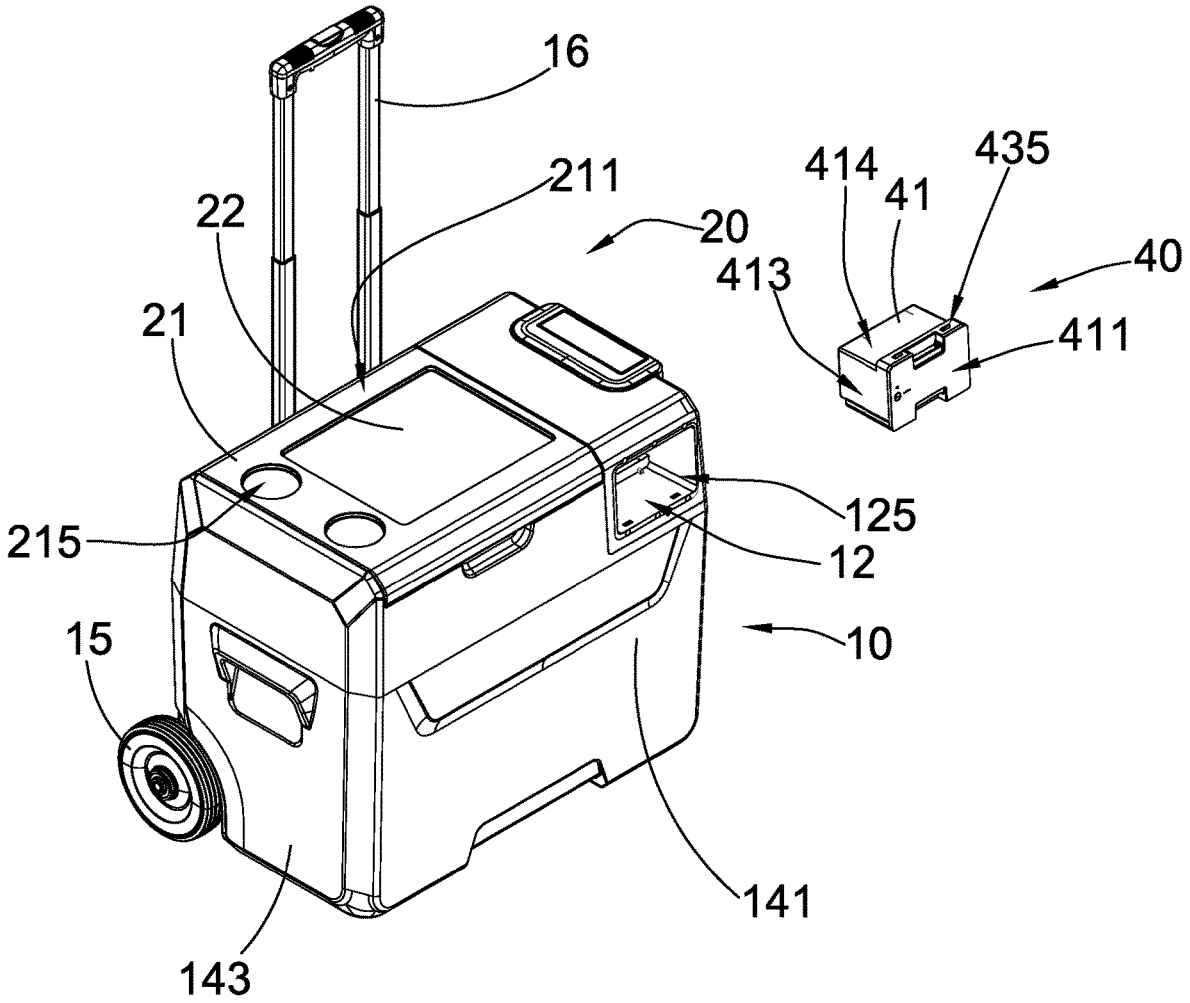
FIG. 3 is a schematic diagram of the portable refrigerator according to the preferred embodiment of the present invention.
Figure 12:
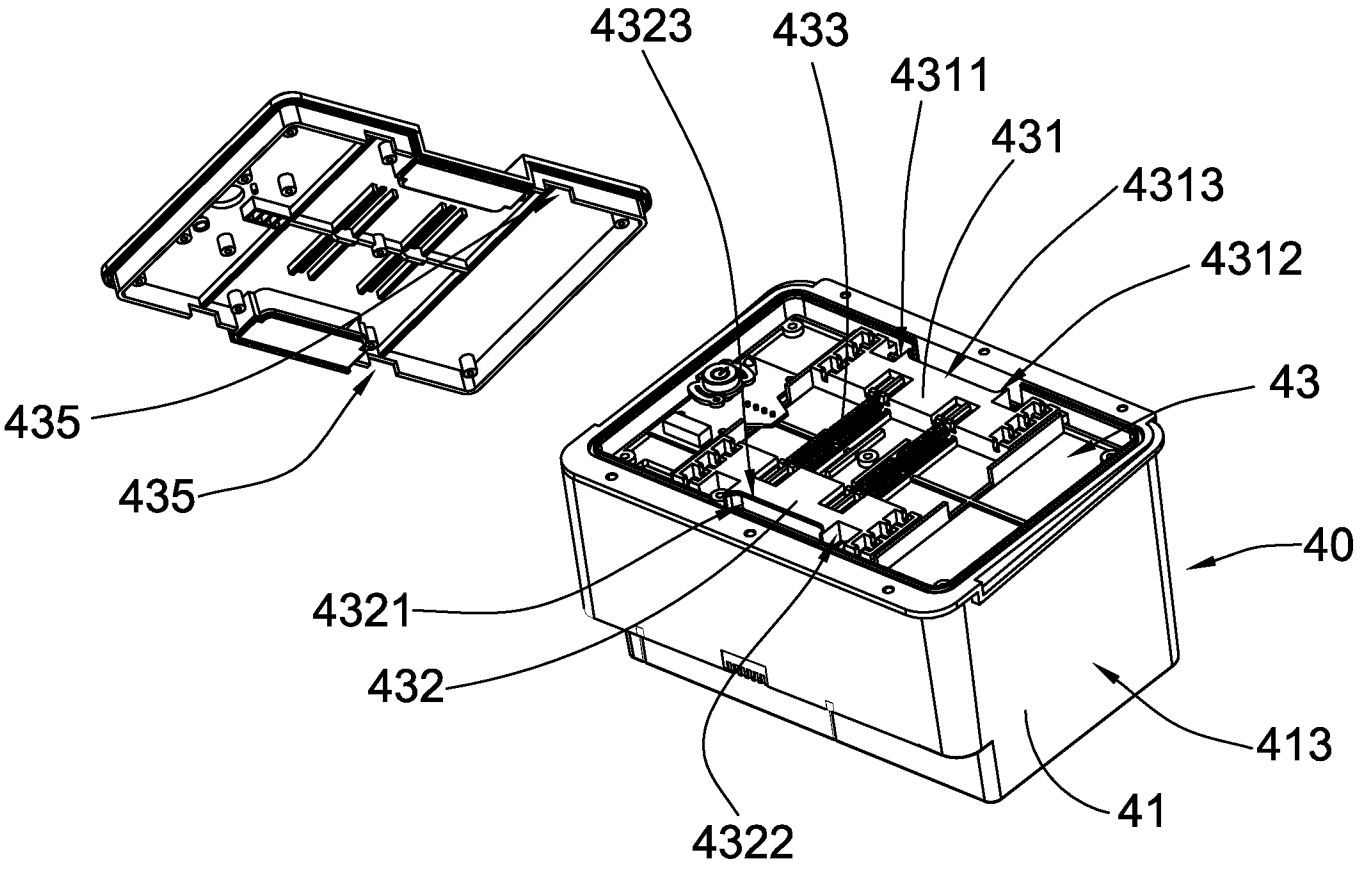
FIG. 12 is an exploded perspective view of the rechargeable battery pack of the portable refrigerator according to the preferred embodiment of the present invention.
Figure 14:
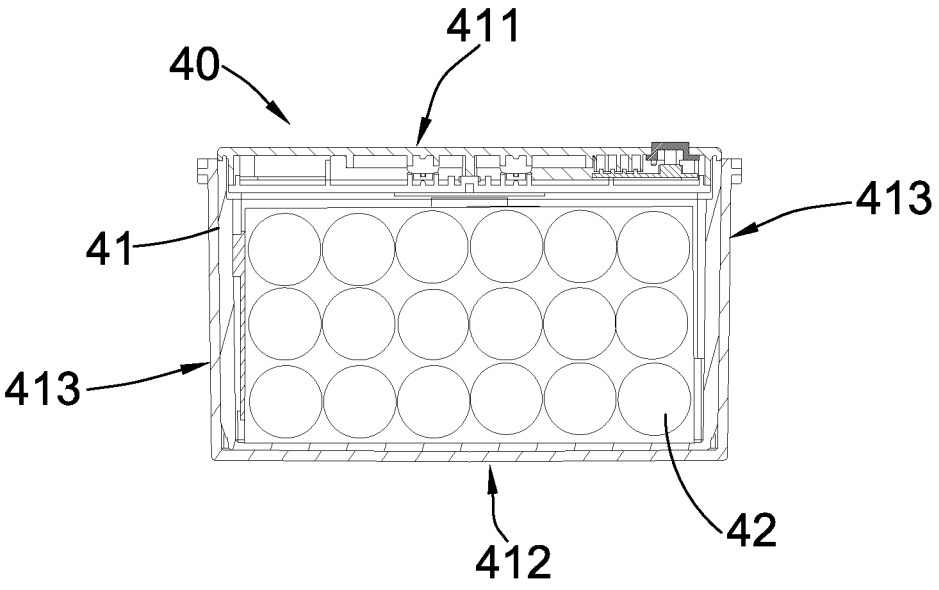
FIG. 14 is a schematic diagram of the rechargeable battery pack of the portable refrigerator according to the preferred embodiment of the present invention.
Figure 15:
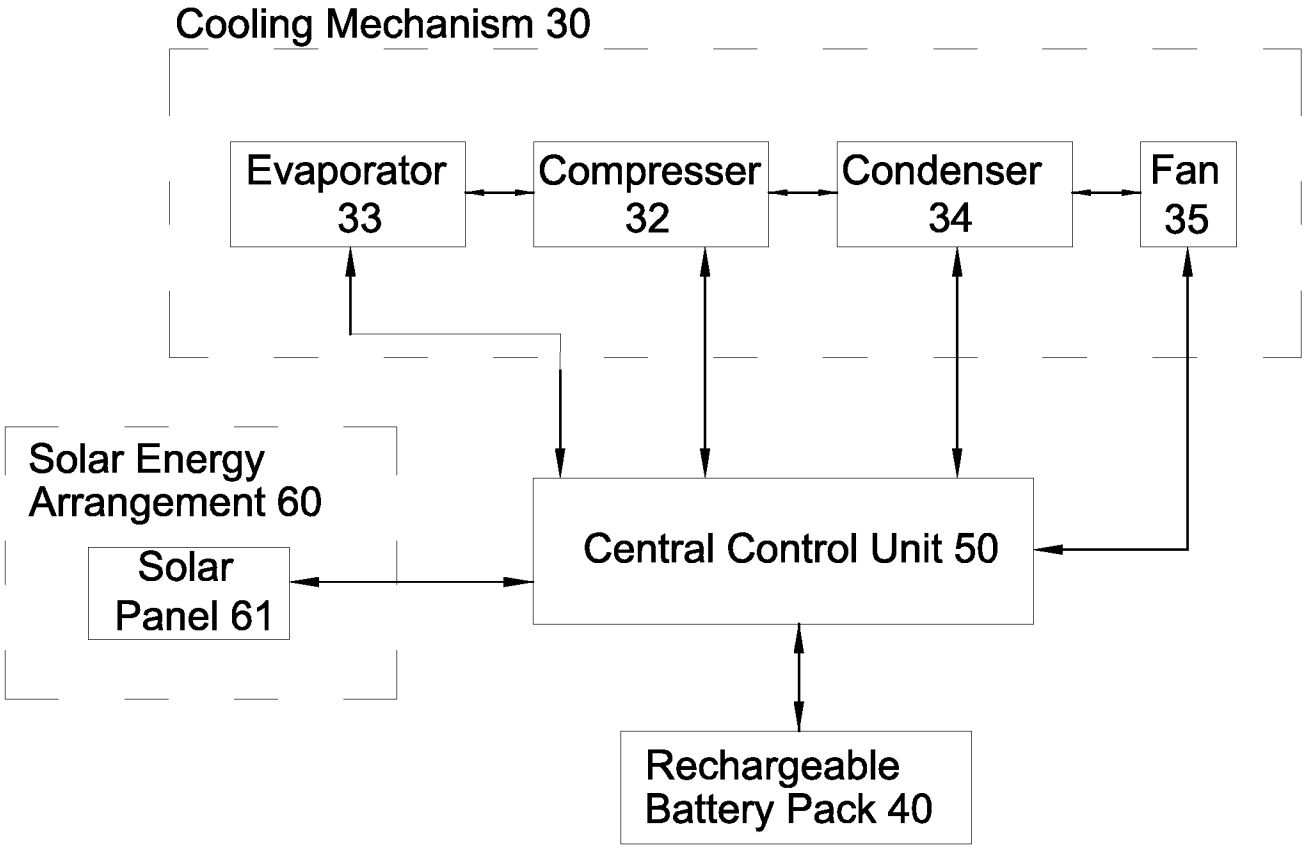
FIG. 15 is a block diagram of a central control unit and cooling mechanism of the portable refrigerator according to the preferred embodiment of the present invention.

Referring to FIG. 3, FIG. 12 and FIG. 14 of the drawings, the rechargeable battery pack 40 may comprise a battery housing 41 and a battery core 42 received in the battery housing 41 for storing electric power. The battery housing 41 may have a front battery surface 411, a rear battery surface 412, two side battery surfaces 413, a top battery surface 414 and a bottom battery surface 415. The battery housing 41 may be configured to resemble a largely rectangular cross-sectional shape when viewed from the front. The battery housing 41 may be fittedly and detachably accommodated in the power compartment 12 of the main housing 10.

Figure 13:
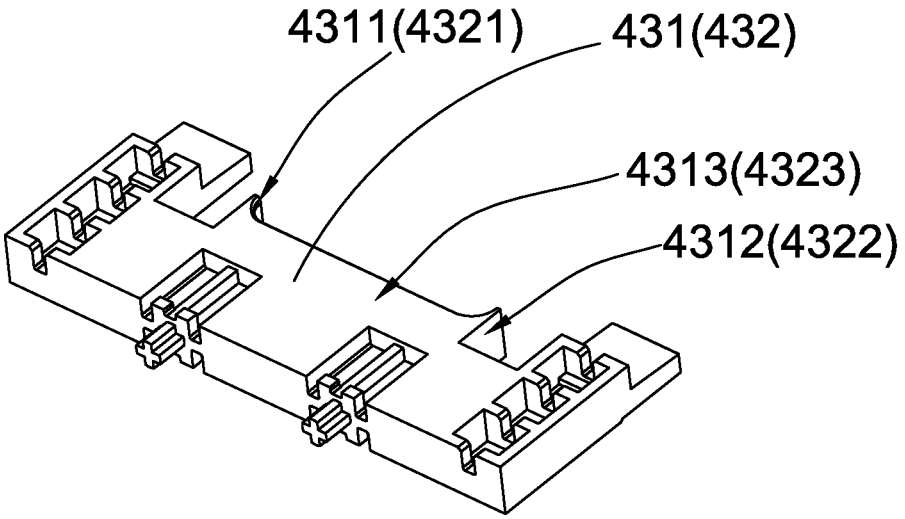
FIG. 13 is a perspective view of the actuating member of the portable refrigerator according to the preferred embodiment of the present invention.

Referring to FIG. 3 and FIG. 12 to FIG. 13 of the drawings, the rechargeable battery pack 40 may further comprise a locking arrangement 43 operatively provided on the battery housing 41 for allowing the battery housing 41 to be selectively locked or detached from the power compartment 12. Specifically, the locking arrangement 43 may comprise a first actuating member 431, a second actuating member 432 and a plurality of resilient element 433 mounted on the first actuating member 431 and the second actuating member 432 to normally exert a biasing force thereto.

On the other hand, the locking arrangement 43 may further contain a plurality of through passage holes 435 formed on the battery housing 41, wherein parts of the first actuating member 431 and the second actuating member 432 may selectively pass through the corresponding through passage holes 435 (described below).

The first actuating member 431 has a first locking latch 4311, a second locking latch 4312, and a first depressing member 4313 positioned between the first locking latch 4311 and the second locking latch 4312. The first actuating member 431 may be mounted in the battery housing 41 such that the first locking latch 4311, the second locking latch 4312 and the first depressing member 4313 may align with three of the corresponding through passage holes 435 respectively. At least one of the resilient elements 433 may normally exert a biasing force against the first actuating member 431 so as to drive the first locking latch 4311, the second locking latch 4312 and the first depressing member 4313 to normally expose out of the battery housing 41 through the corresponding through passage holes 435.

Similarly, the second actuating member 432 has a third locking latch 4321, a fourth locking latch 4322, and a second depressing member 4323 positioned between the third locking latch 4321 and the fourth locking latch 4322. The second actuating member 432 may be mounted in the battery housing 41 such that the third locking latch 4321, the fourth locking latch 4322 and the second depressing member 4323 may align with another three of the corresponding through passage holes 435 respectively. At least one of the resilient elements 433 may normally exert a biasing force against the second actuating member 432 so as to drive the third locking latch 4321, the fourth locking latch 4322 and the second depressing member 4323 to normally expose out of the battery housing 41 through the corresponding through passage holes 435.

It is worth mentioning that the first actuating member 431 may be provided on an upper portion of the battery housing 41 while the second actuating member 432 may be provided on a lower portion of the same battery housing 41. Accordingly, two of the through passage holes 435 may be provided on the top battery surface 414, and another two of the through passage holes 435 may be provided on the bottom battery surface 415 of the battery housing 41.

Figure 16:
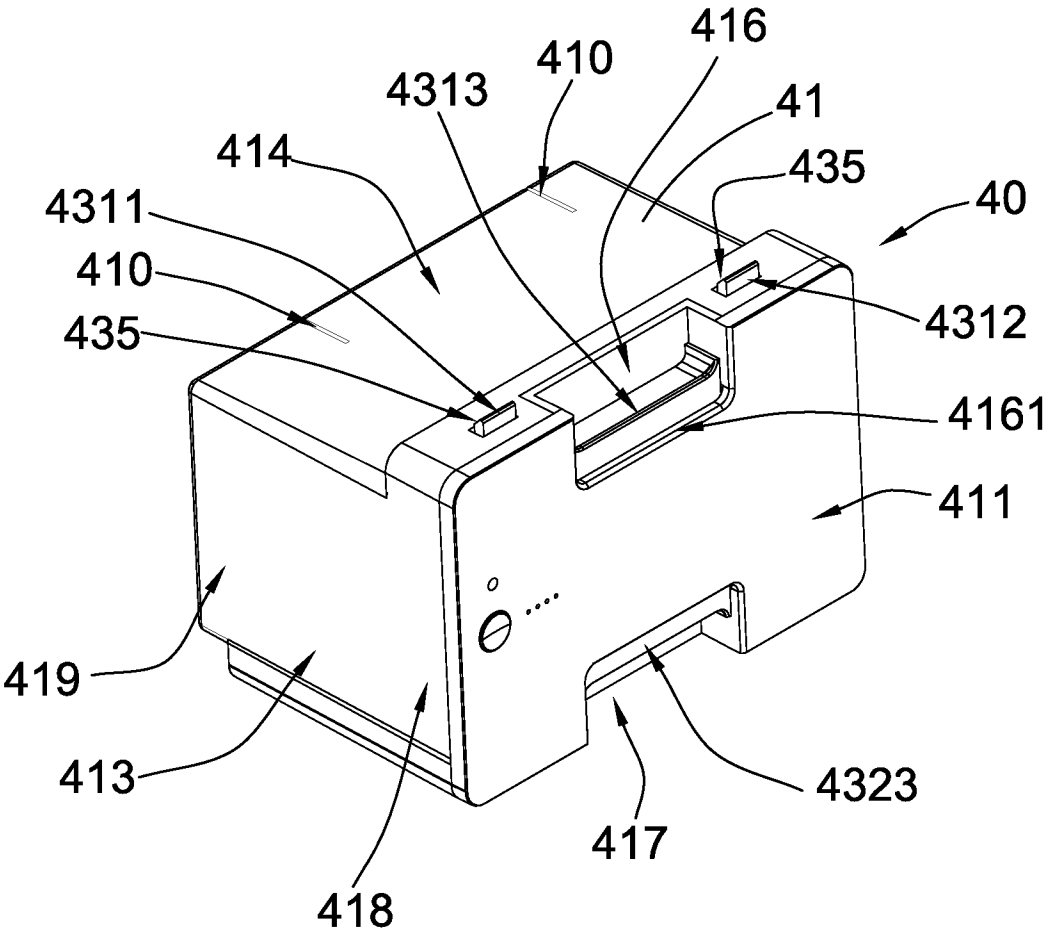
FIG. 16 is a top perspective view of the rechargeable battery pack of the portable refrigerator according to the preferred embodiment of the present invention.
Figure 17:
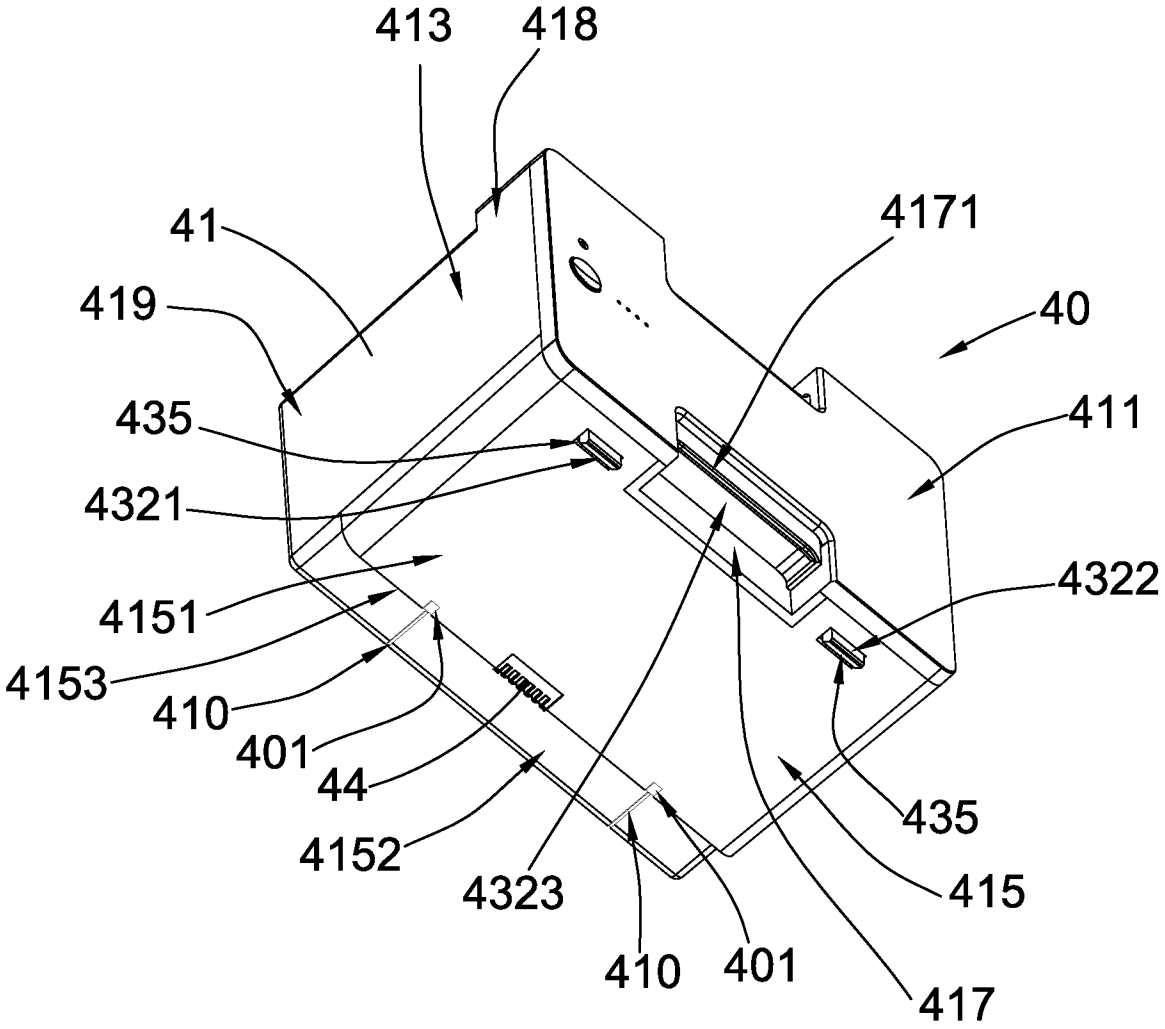
FIG. 17 is a bottom perspective view of the rechargeable battery pack of the portable refrigerator according to the preferred embodiment of the present invention.

As shown in FIG. 16 to FIG. 17 of the drawings, the battery housing 41 may further have a first battery indention 416 indently formed on the front battery surface 411 and the top battery surface 414. Similarly, the battery housing 41 may further have a second battery indention 417 indently formed on the front battery surface 411 and the bottom battery surface 415 wherein two of the through passage holes 435 may be formed on the first indention surface 4161 of the first battery indention 416 and a second indention surface 4171 of the second battery indention 417 respectively. The first depressing member 4313 and the second depressing member 4323 may be pushed to expose out of the battery housing 41 through the through passage holes 435 formed on the inner surfaces 4161 of the battery indentions 416 respectively.

As shown in FIG. 1 to FIG. 2 and FIG. 6 to FIG. 8 of the drawings, the first battery indention 416 may be formed at a position between the first locking latch 4311 and the second locking latch 4312, and the second battery indention 417 may be formed at a position between the third locking latch 4321 and the fourth locking latch 4322. The first indention surface 4161 may be substantially parallel to the top battery surface 414, while the second indention surface 4171 may be substantially parallel to the bottom battery surface 415.

The battery housing 41 may be divided into a front thicker portion 418 and a rear thinner portion 419 so that a vertical height of the front thicker portion 418 is greater than that of the rear thinner portion 419. As such, the bottom battery surface 415 of the battery housing 41 may be divided into a front section 4151 and a rear section 4152, wherein the front section 4151 may be formed as the bottom surface of the front thicker portion 418 of the battery housing 41, while the rear section 4152 may be formed as the bottom surface of the rear thinner portion 419. The second battery indention 417, the third locking latch 4321 and the fourth locking latch 4322 may be provided on the front section 4151 of the bottom battery surface 415. A biasing surface 4153 may be formed as the boundary surface between the front section 4151 and the rear section 4152. This biasing surface 4153 may be parallel to the front battery surface 411 and the rear battery surface 412.

The battery housing 41 may further have a plurality of securing slots 410 formed on the top battery surface 414 and rear section 4152 of the bottom battery surface 415 respectively. These securing slots 410 may be formed on the rear thinner portion 419 of the battery housing 41.

Moreover, the rechargeable battery pack 40 may further comprise a connection port 44 provided on the bottom battery surface 415 of the battery housing 41. The connection port 44 may be electrically connected to the battery core 42 so that it may be used as a power outlet for the rechargeable battery pack 40. In this preferred embodiment of the present invention, the connection port 44 may be provided on the front section 4151 of the bottom battery surface 415 and the biasing surface 4153.

The battery housing 41 may further have a plurality of positioning recesses 401 provided on the bottom battery surface 415 for further assisting positioning of the battery housing 41 in the power compartment 12. Each of the positioning recesses 401 may extend on the front section 4151 and the biasing surface 4153 and align with a longitudinal direction of a corresponding securing slot 420.

Referring to FIG. 3 and FIG. 9 to FIG. 11 of the drawings, the power compartment 12 may be surrounded by a plurality of surfaces. Specifically, the power compartment 12 may be surrounded by a top compartment surface 121, a bottom compartment surface 122, a rear compartment surface 123, and two side compartment surfaces 124. The power compartment 12 may therefore be surrounded by the top compartment surface 121, the bottom compartment surface 122, the rear compartment surface 123, and the two side compartment surfaces 124. Moreover, the main housing 10 may further have a compartment opening 125 communicating the power compartment 12 with an exterior of the main housing 10. Thus, the power compartment 12 may be defined as a cavity for accommodating the rechargeable battery pack 40 and may be surrounded by the top compartment surface 121, the bottom compartment surface 122, the rear compartment surface 123, and the two side compartment surfaces 124.

In order to accommodate the bottom battery surface 415 of the battery housing 41, the bottom compartment surface 122 may also be divided into a front segment 1221 and a rear segment 1222 wherein a vertical height of the front segment 1221 and the rear segment 1222 with respect to the top compartment surface 121 may be different. The front segment 1221 may be formed at a position lower than that of the rear segment 1222. An urging surface 1223 may be formed as the boundary surface between the front segment 1221 and the rear segment 1222. This urging surface 1223 may be parallel to the rear compartment surface 123.

The main housing 10 may further comprise a plurality of securing ridges 1224 formed on the top compartment surface 121 and the rear segment 1222 of the bottom compartment surface 122 at positions corresponding to the securing slots 420 of the battery housing 41. When the rechargeable battery pack 40 is accommodated in the power compartment 12, the securing ridges 1224 may be arranged to engage with the securing slots 420 respectively so as to secure the rechargeable battery back 40 in the power compartment 12.

Moreover, the main housing 10 may further comprise a plurality of positioning protrusions 1225 formed on the front segment 1221 of the bottom compartment surface 122 at positions corresponding to the positioning recesses 401 of the battery housing 41. When the rechargeable battery pack 40 is accommodated in the power compartment 12, the positioning protrusions 1225 may be arranged to engage with the positioning recesses 401 respectively so as to secure the rechargeable battery back 40 in the power compartment 12.

The main housing 10 may further comprise a power inlet 19 formed on the urging surface 1223 of the power compartment 12 for electrically connecting to the connection port 44 of the rechargeable battery pack 40. The locking arrangement 43 may further has a plurality of locking slots 436 formed on the top compartment surface 121 and the bottom compartment surface 122, wherein at least some of the locking slots 436 may be positioned corresponding to the first locking latch 4311, the second locking latch 4312, the third locking latch 4321 and the fourth locking latch 4322 respectively so that the first locking latch 4311, the second locking latch 4312, the third locking latch 4321 and the fourth locking latch 4322 may partially receive in the corresponding locking slot 436 for detachably locking the battery housing 41 in the battery compartment 12. When the first depressing member 4313 and the second depressing member 4323 are depressed, the first locking latch 4311, the second locking latch 4312, the third locking latch 4321 and the fourth locking latch 4322 may also be driven to move to disengage from the corresponding locking slot 436 so as to allow detachment of the battery housing 41 from the battery compartment 12.

The portable refrigerator may further comprise a solar energy arrangement 60 which may comprise a solar panel 61 detachably attached on the main housing 10 provided in the components compartment 13 and electrically connected to the central control unit 50. The main housing 10 may detachably connect to the solar panel 61 for collecting solar energy. The solar energy collected may be controlled and managed by the central control unit 50. The solar energy may be stored in the rechargeable battery pack 40. The solar energy may then be converted into electrical energy which may be supplied to various components of the portable refrigerator as controlled by the central control unit 50.

Figure 18:
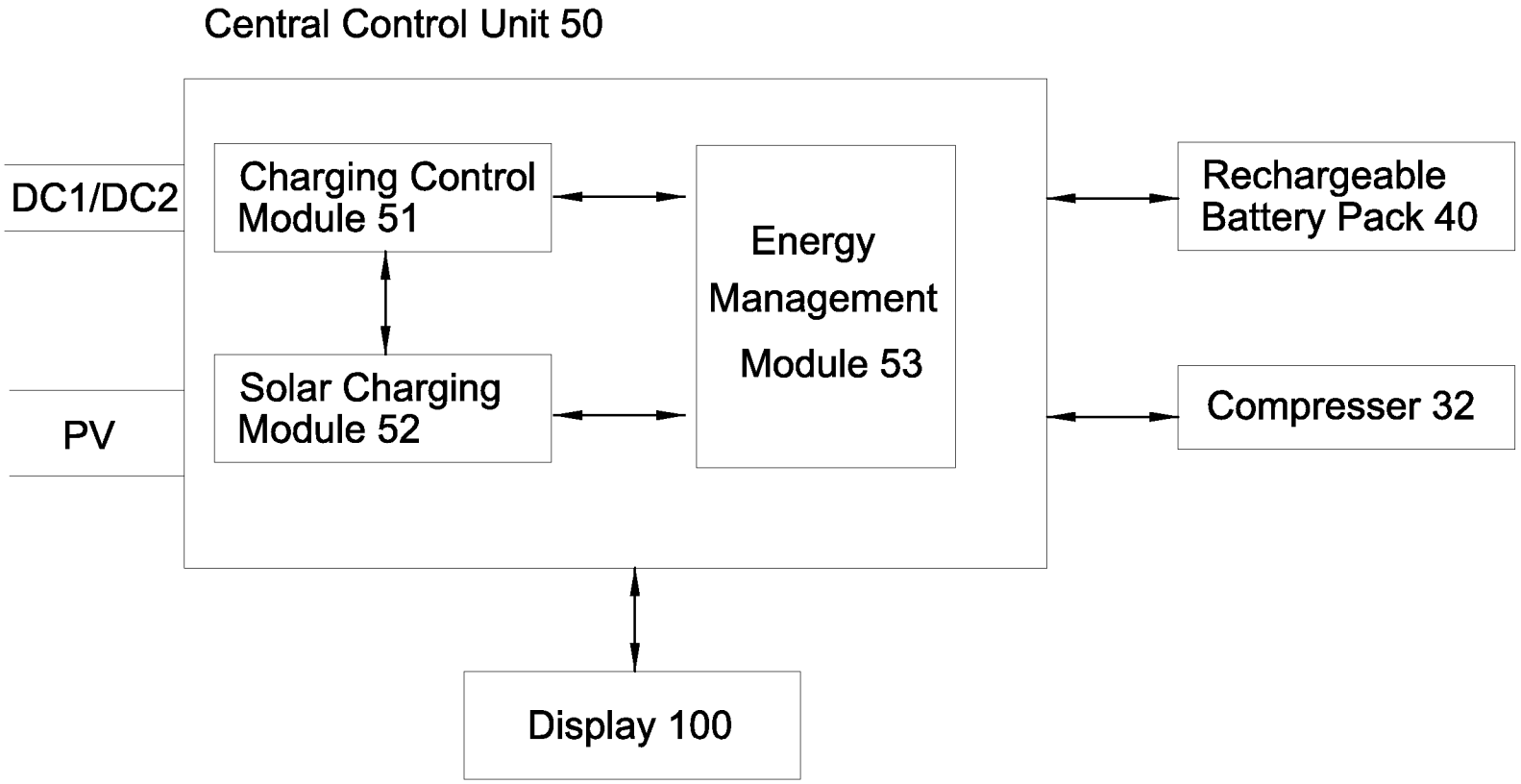
FIG. 18 is a block diagram of a central control unit of the portable refrigerator according to the preferred embodiment of the present invention.
Figure 19A:
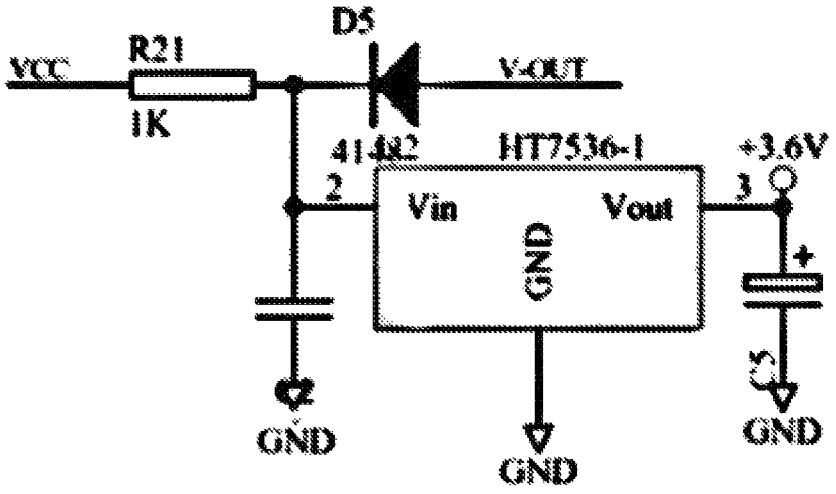
FIG. 19A to FIG. 19E are circuit diagrams of a charging control module of a central control unit of the portable refrigerator according to the preferred embodiment of the present invention.
Figure 19B:
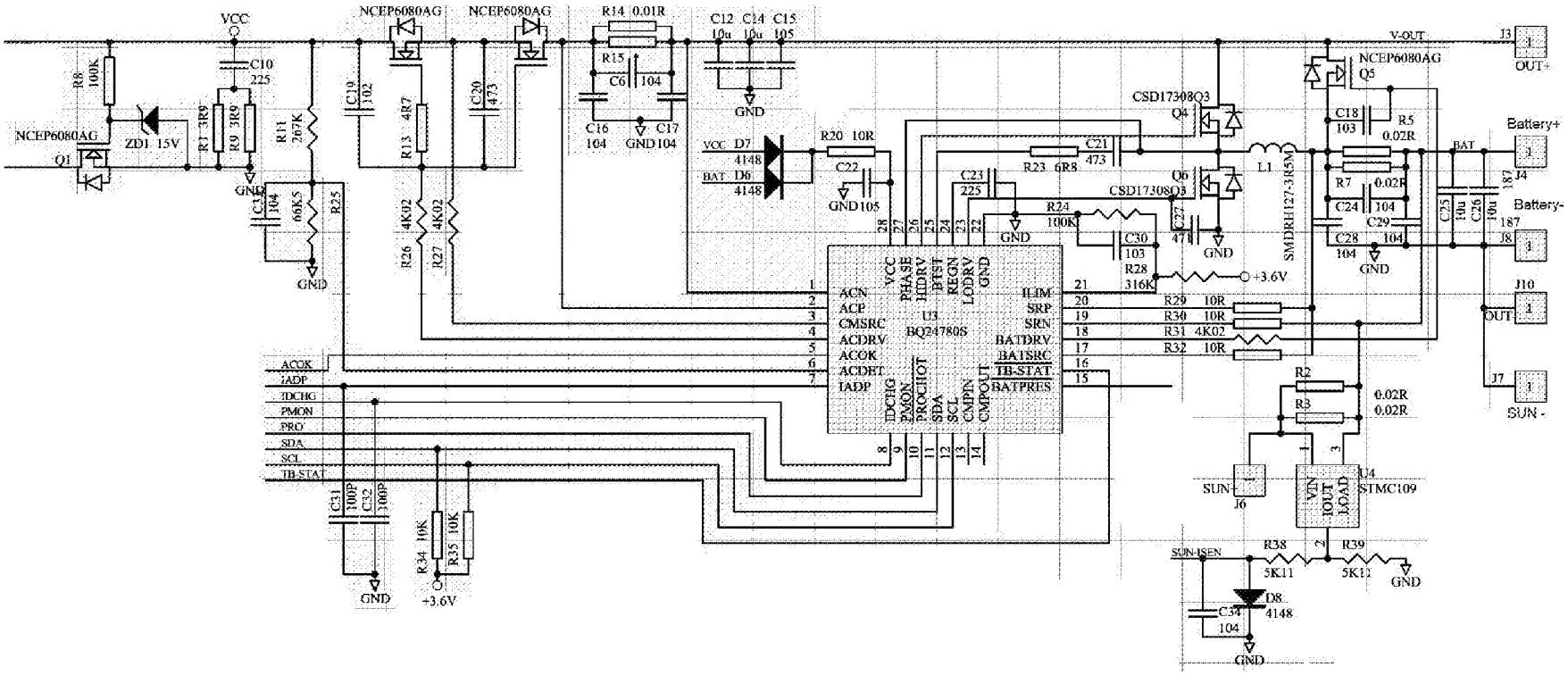
Figure 19C:
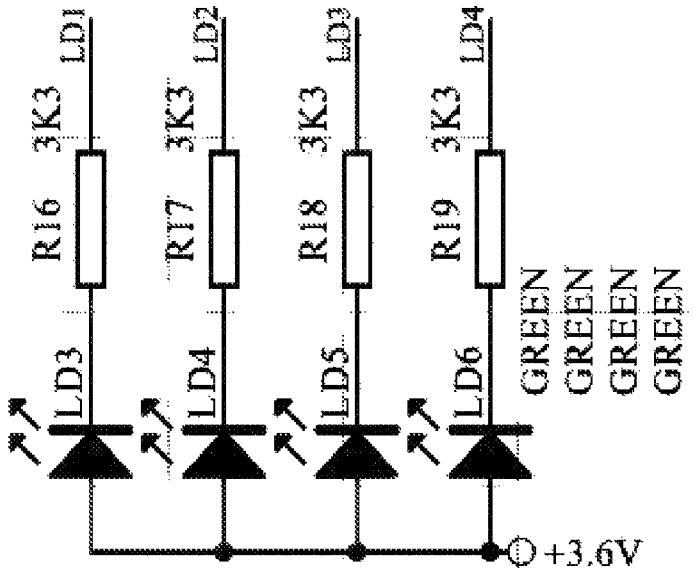
Figure 19D:
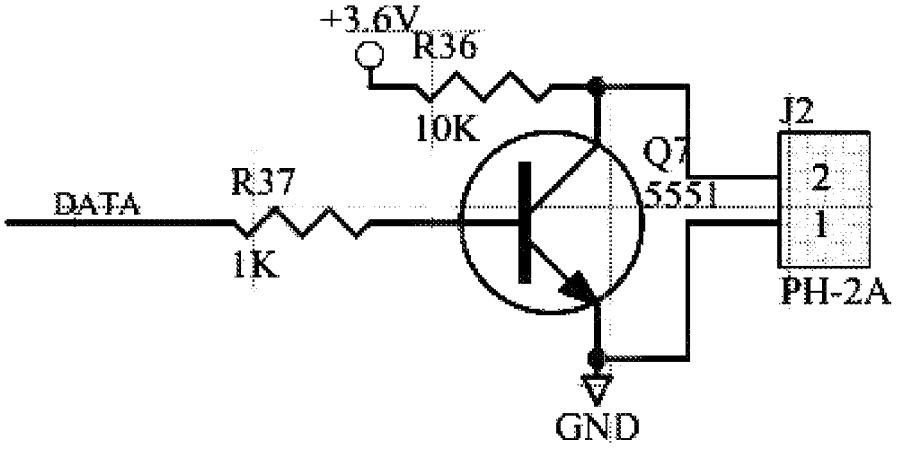
Figure 19E:
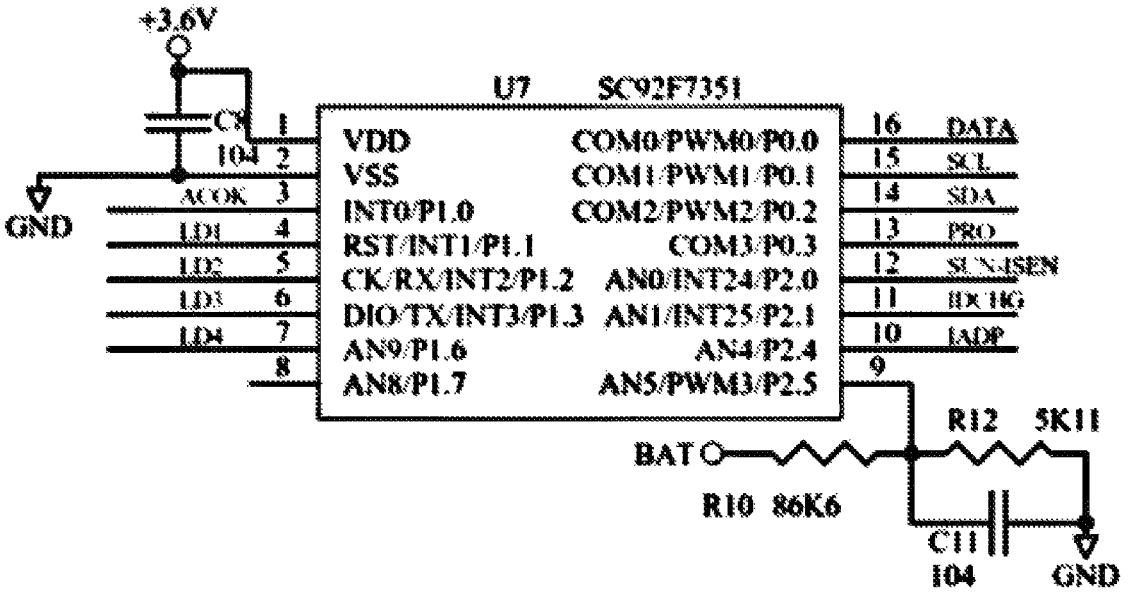
Figure 20A:
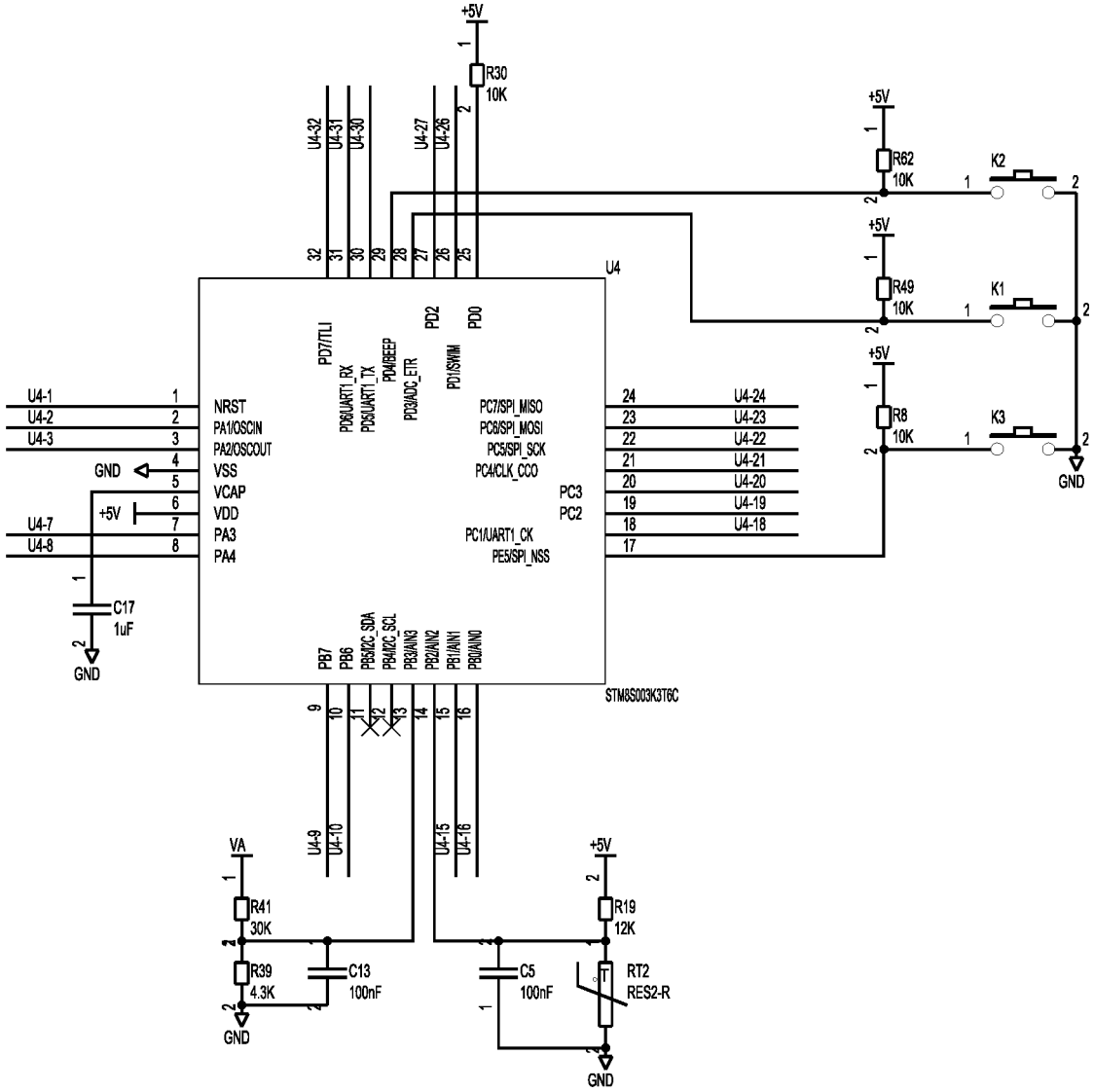
FIG. 20A to FIG. 20H are circuit diagrams of a solar charging module of a central control unit of the portable refrigerator according to the preferred embodiment of the present invention.
Figure 20B:
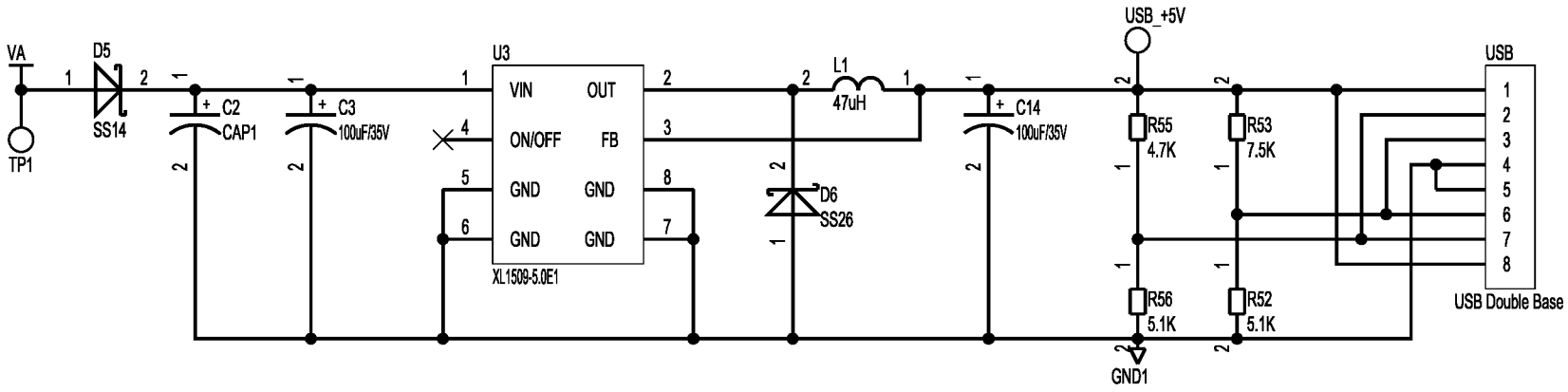
Figure 20C:
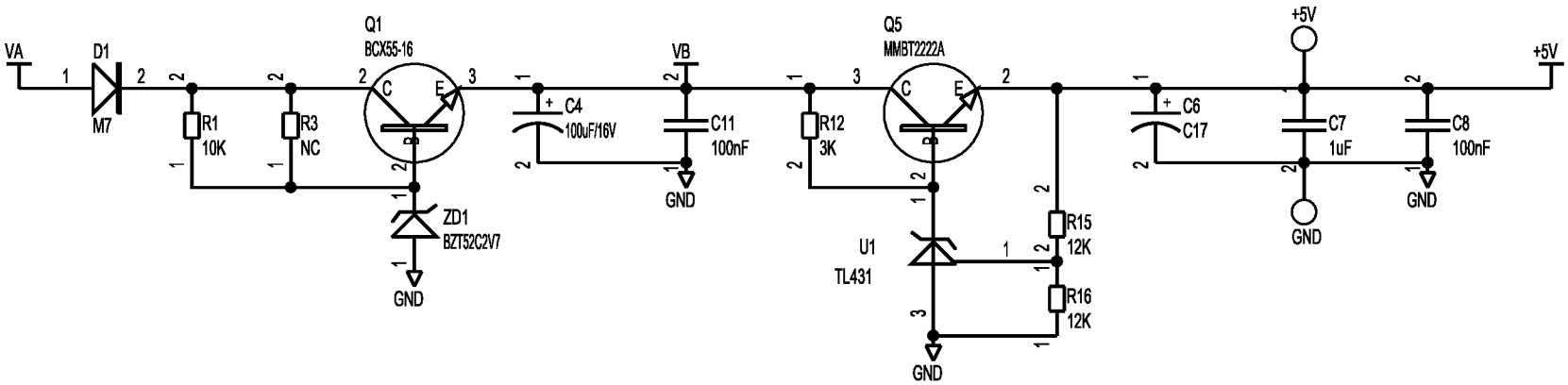
Figure 20D:
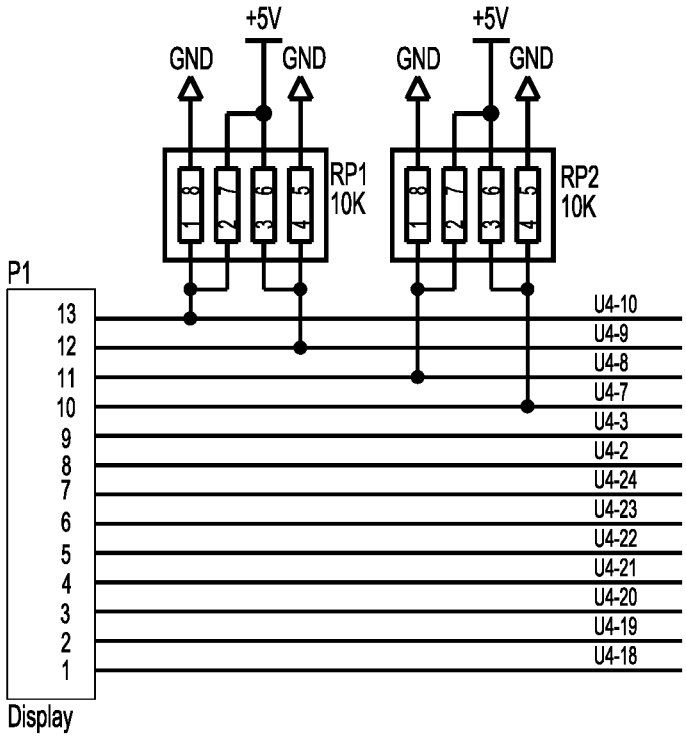
Figure 20E:
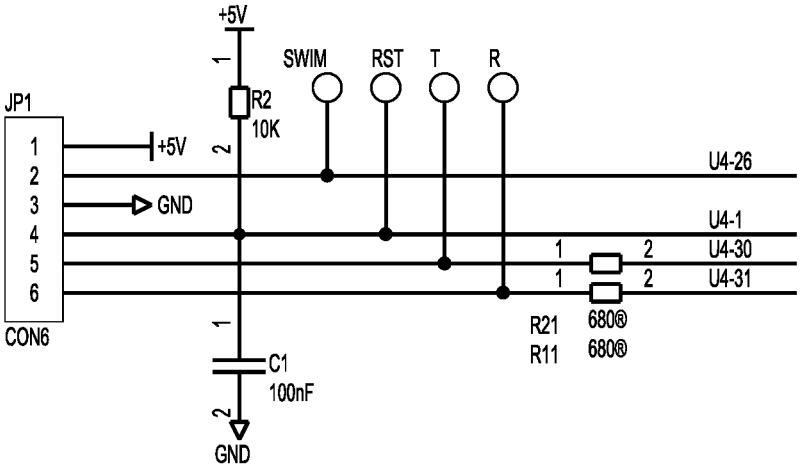
Figure 20F:
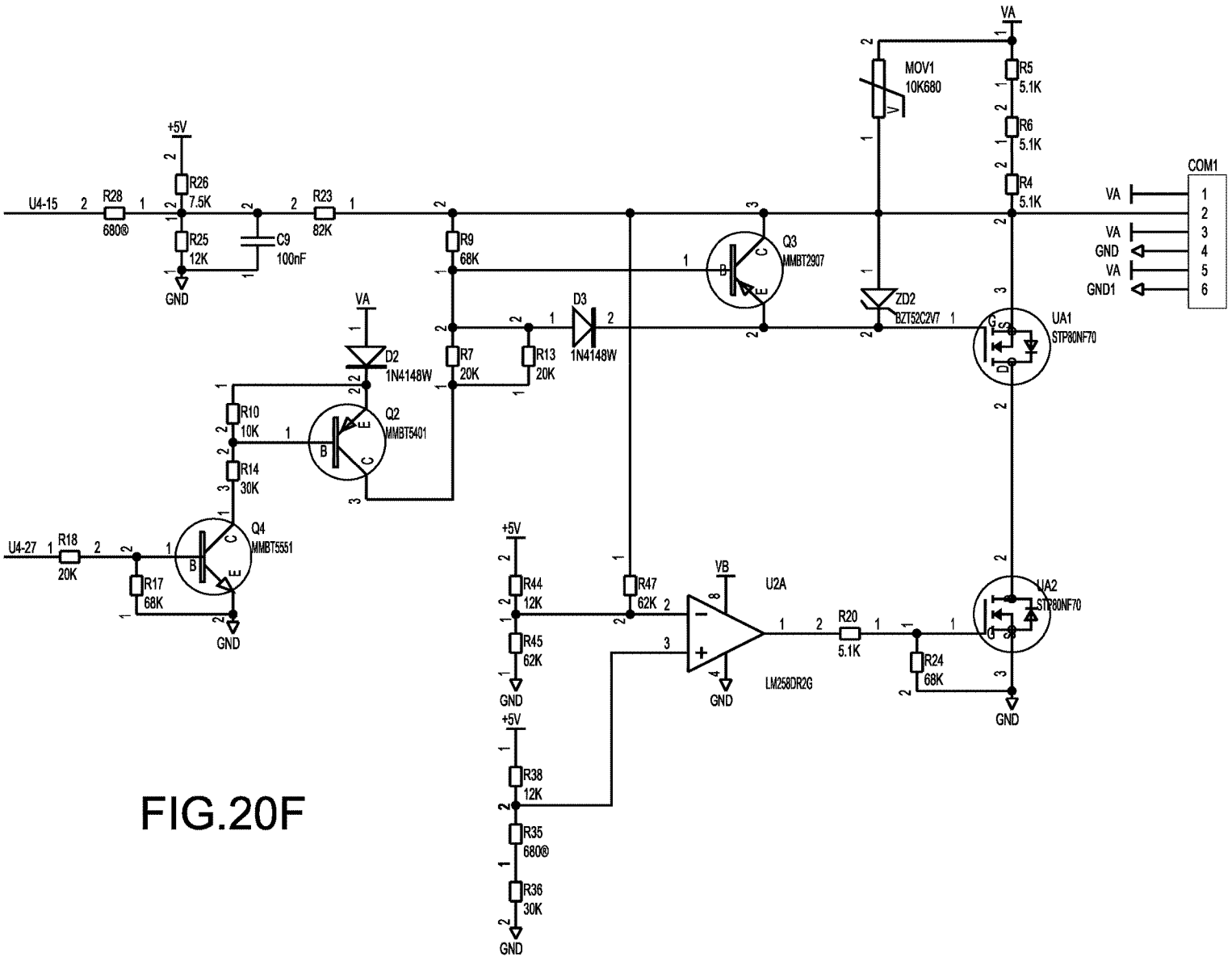
Figure 20G:
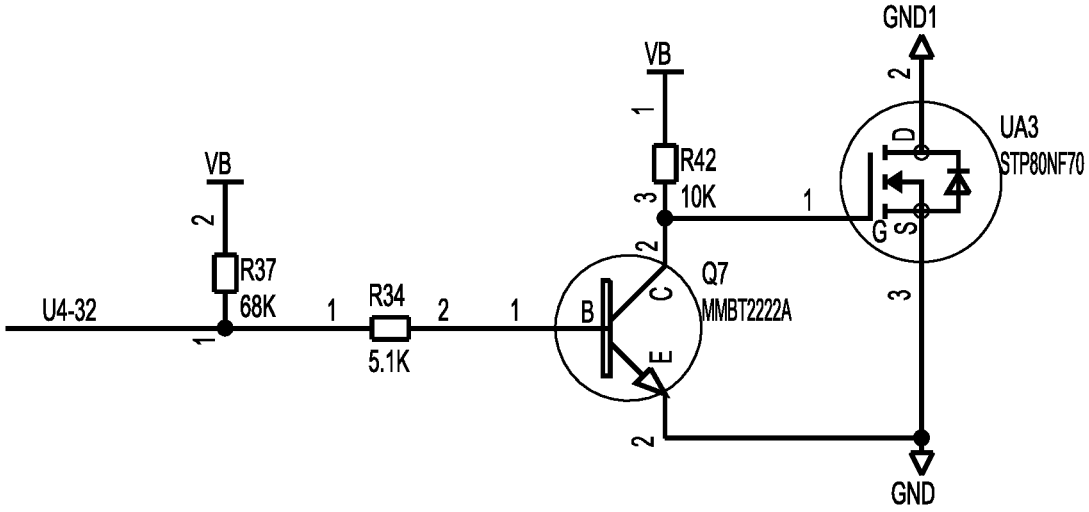
Figure 20H:
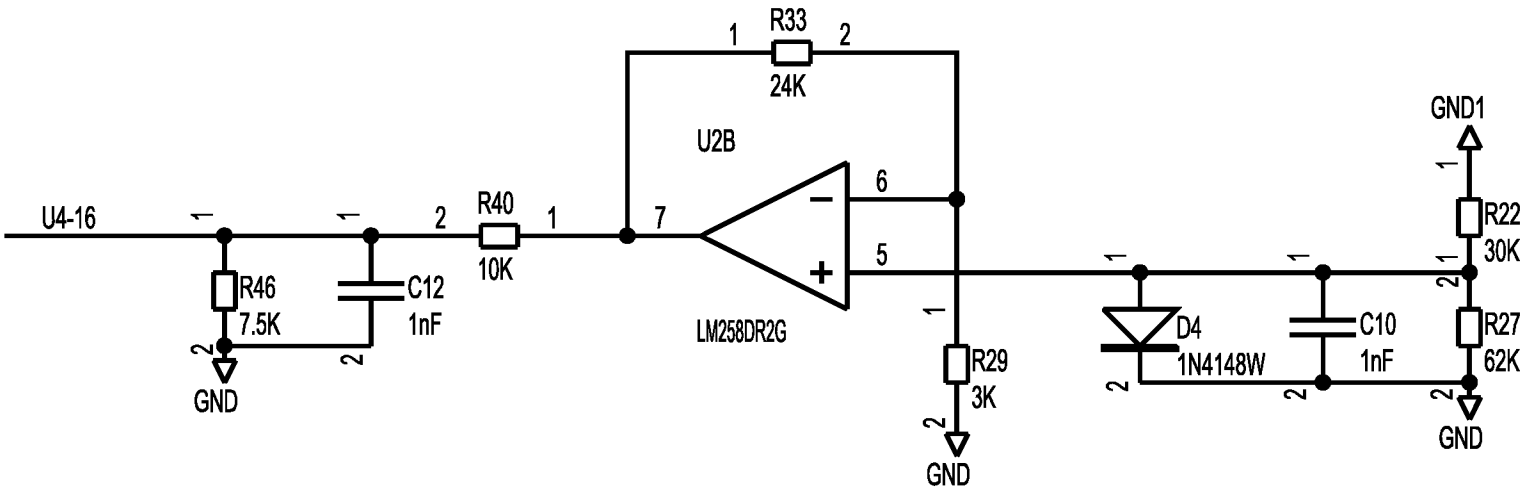

Referring to FIG. 18 of the drawings, the central control unit 50 may comprise a charging control module 51, a solar charging module 52, and an energy management module 53. In describing the central control unit 50 below, references will be made as follows: FIG. 19A to FIG. 19E illustrate the circuit diagram for each of the charging control module 51 while FIG. 20A to FIG. 20H illustrate the circuit diagram of the solar charging module 52.

The charging control module 51 may comprise an integrated chip HT7536-1, an integrated chip U3, an integrated chip U4, an integrated chip U7, a Zener diode ZD1, a diode D5, a diode D6, a diode D7, a diode D8, a light emitting diode LD3, a light emitting diode LD4, a light emitting diode LD5, a light emitting diode LD6, a transistor Q7, a metal-oxide-semiconductor field-effect transistor MOSFET Q1, a MOSFET Q2, a MOSFET Q3, a MOSFET Q4, a MOSFET Q5, a MOSFET Q6, a resistor R1, a resistor R2, a resistor R3, a resistor R5, a resistor R7, a resistor R8, a resistor R9, a resistor R10, a resistor R11, a resistor R12, a resistor R13, a resistor R14, a resistor R15, a resistor R16, a resistor R17, a resistor R18, a resistor R19, a resistor R20, a resistor R21, a resistor R23, a resistor R24, a resistor R25, a resistor R26, a resistor R27, a resistor R28, a resistor R29, a resistor R30, a resistor R31, a resistor R32, a resistor R34, a resistor R35, a resistor R36, a resistor R37, a resistor R38, a resistor R39, a capacitor C2, a capacitor C3, a capacitor C5, a capacitor C6, a capacitor C8, a capacitor C10, a capacitor C11, a capacitor C12, a capacitor C14, a capacitor C15, a capacitor C16, a capacitor C17, a capacitor C18, a capacitor C19, a capacitor C20, a capacitor C21, a capacitor C22, a capacitor C23, a capacitor C24, a capacitor C25, a capacitor C26, a capacitor C27, a capacitor C28, a capacitor C29, a capacitor C30, a capacitor C31, a capacitor C32, a capacitor C34 and an inductor L1.

The solar charging module 52 may comprise an integrated chip JP1, an integrated chip P1, an integrated chip U4, the integrated chip U3, an integrated chip USB, an integrated chip COM1, a diode D1, a diode D2, a diode D3, a diode D4, the diode D5, the diode D6, the Zener diode ZD1, a Zener diode ZD2, a Zener diode U1, a transistor Q1, a transistor Q2, a transistor Q3, a transistor Q4, a transistor Q5, a transistor Q7, a MOSFET UAL a MOSFET UA2, a MOSFET UA3, a resistor group RP1, a resistor group RP2, the inductor L1, a variable resistor RT2, a variable resistor MOV1, a resistor R1, a resistor R2, a resistor R3, a resistor R4, a resistor R5, a resistor R6, a resistor R7, a resistor R8, a resistor R9, a resistor R10, a resistor R11, a resistor R12, a resistor R13, a resistor R14, a resistor R15, a resistor R16, a resistor R17, a resistor R18, a resistor R19, a resistor R20, a resistor R21, a resistor R22, a resistor R23, a resistor R24, a resistor R25, a resistor R26, a resistor R27, a resistor R28, a resistor R29, a resistor R30, a resistor R33, a resistor R34, a resistor R35, a resistor R36, a resistor R37, a resistor R38, a resistor R39, a resistor R40, a resistor R41, a resistor R42, a resistor R44, a resistor R45, a resistor R46, a resistor R47, a resistor R49, a resistor R52, a resistor R53, a resistor R55, a resistor R56, a resistor R62, a capacitor C1, the capacitor C2, the capacitor C3, the capacitor C5, a capacitor C7, a capacitor C8, a capacitor C9, a capacitor C10, a capacitor C11, a capacitor C12, a capacitor C13, a capacitor C14, a capacitor C17, an electrolytic capacitor C4, an electrolytic capacitor C6, a switch R1, a switch K2, a switch K3, an operational amplifier U2A and an operational amplifier U2B. Each of the above-mentioned resistors and capacitors may have two terminals. Each of the above-mentioned diodes and Zener diodes may have a positive terminal and a negative terminal. Each of the above-mentioned transistors may have a gate terminal, an emitter terminal, and a collector terminal. Each of the above-mentioned MOSFET may have; a source terminal, a gate terminal and a drain terminal.

In the charging control module 51, one terminal of resistor R8 may be electrically connected to a negative terminal of the Zener diode ZD1, a Gate terminal of MOSFET Q1. Another terminal of the resistor R8 may be electrically connected to a power source VCC, capacitor C10, capacitor C19 and a Drain terminal of MOSFET Q2.

Moreover, a Source terminal of MOSFET Q1, a positive terminal of Zener diode ZD1, a terminal of resistor R1 and a terminal of resistor R9 may be connected to Ground. Another terminal of resistor R1 may be electrically connected to capacitor C10 and another terminal of resistor R9. Resistor R11 may be electrically connected to capacitor C3, resistor R23, and a sixth pin of integrated chip U3. Capacitor C3 and resistor R25 may also be connected to Ground. Resistor C19 may be electrically connected to resistor R13, resistor R26, capacitor C20, and a Gate terminal of MOSFET Q3. Resistor R13 may be electrically connected to a Gate terminal of MOSFET Q2. A Source terminal of MOSFET Q2 may be electrically connected to resistor R27, capacitor C20 and a Source terminal of MOSFET Q3. Resistor R26 may be electrically connected to a fourth pin of integrated chip U3. Resistor R27 may be electrically connected to a fourth pin of integrated chip U3. A Drain terminal of MOSFET Q3 may be electrically connected to a terminal of resistor R14, a terminal of resistor R15, a terminal of capacitor C6, a terminal of capacitor C16 and second pin of integrated chip U3. Another terminal of resistor R14 may also be electrically connected to another terminal of resistor R15, another terminal of capacitor C6, a terminal of capacitor C17, a terminal of capacitor C12, a terminal of capacitor C14, a terminal of capacitor C15, a Drain terminal of MOSFET Q4, a Drain terminal of MOSFET Q5, an output J3, and a first pin of integrated chip U3. Another terminal of capacitor C16 and another terminal of capacitor C17 may be connected to the Ground. Furthermore, another terminal of capacitor C12, another terminal of capacitor C14, and another terminal of capacitor C15 may also be connected to Ground.

Signal ACOK may be electrically connected to a fifth pin of integrated chip U3. Signal IADP may be electrically connected to a terminal of capacitor C31 and a seventh pin of integrated chip U3. Signal IDCHG may be electrically connected to a terminal of capacitor C32 and an eighth pin of integrated chip U3. Another terminal of capacitor C31 and capacitor C32 may be connected to Ground. Signal PMON may be electrically connected to a ninth pin of integrated chip U3. Signal PRO may be electrically connected to a tenth pin of integrated chip U3. Signal SDA may be electrically connected to a terminal of resistor R34 and an eleventh pin of integrated chip U3. Signal SCL may be electrically connected to a terminal of resistor R35 and a twelfth pin of integrated chip U3. Another terminal of resistor R34 and resistor R35 may be connected to +3.6V voltage supply. Signal TB-STAT may be electrically connected to a sixteenth pin of integrated chip U3.

A positive terminal of diode D7 may be electrically connected to positive voltage supply VCC. A positive terminal of diode D6 may be electrically connected to power supply BAT. A negative terminal of diode D7 may be electrically connected to a negative terminal of diode D6 and a terminal of resistor R20. Another terminal of resistor R20 may be electrically connected to another terminal of capacitor C22, and a twenty eighth pin of integrated chip U3. Another terminal of capacitor C22 may be connected to the Ground. A Source terminal of MOSFET Q4 may be electrically connected to twenty seventh pin of integrated chip U3, a terminal of capacitor C21, a Drain terminal of MOSFET Q6, and a terminal of inductor L1. A Gate terminal of MOSFET Q4 may be electrically connected to a twenty sixth pin of integrated chip U3, another terminal of capacitor C21, and a terminal of resistor R23. Another terminal of resistor R23 may be electrically connected to a twenty fifth pin of integrated chip U3. A terminal of capacitor C23 may be electrically connected to a twenty fourth pin of integrated chip U3. Another terminal of capacitor C23 may be electrically connected to a terminal of resistor R24. A terminal of capacitor C30, and a twenty second pin of integrated chip U3 may be connected to the Ground.

A Gate terminal of MOSFET Q6 may be electrically connected to a twenty third pin of integrated chip U3 and a terminal of capacitor C27. A Source terminal of MOSFET Q6 and another terminal of capacitor C27 may be connected to the Ground. Another terminal of resistor R24 may be electrically connected to another terminal of capacitor C30, a terminal of resistor R28, and a twenty first pin of integrated chip U3. Another terminal of resistor R28 may be electrically connected to +3.6V voltage supply. A terminal of resistor R29 may be electrically connected to a twentieth pin of integrated chip U3. Another terminal of resistor R29 may be electrically connected to Source terminal of MOSFET Q5, a terminal of capacitor C18, another terminal of inductor L1, a terminal of resistor R5, a terminal of resistor R7, a terminal of capacitor C24, a terminal of capacitor C28, and a terminal of resistor R32.

Moreover, a terminal of resistor R30 may be electrically connected to a nineteenth pin of integrated chip U3. Another terminal of resistor R30 may be electrically connected to another terminal of resistor R5, another terminal of resistor R7, another terminal of capacitor C24, a terminal of capacitor C29, a terminal of capacitor C25, a terminal of capacitor C26, a positive terminal of power supply BAT, a terminal of resistor R2, a terminal of resistor R3, a third pin of integrated chip U4.

Another terminal of capacitor C28 may be electrically connected to another terminal of capacitor C29. Another terminal of capacitor C25, another terminal of capacitor C26, a negative terminal of power supply J8, an output terminal of power supply J10 and power supply J7 may all be electrically connected to Ground.

A Gate terminal of MOSEFT Q5 may be electrically connected to another terminal of capacitor C18 and a terminal of resistor R31. Another terminal of resistor R31 may be electrically connected to an eighteenth pin of integrated chip U3. Another terminal of resistor R32 may be electrically connected to a seventeenth pin of integrated chip U3. Another terminal of resistor R2 may be electrically connected to another terminal of resistor R3, a first pin of integrated chip U4, and power supply J6. A second pin of integrated chip U4 may be electrically connected to a terminal of resistor R39, and a terminal of resistor R38. Another terminal of resistor R39 may be connected to Ground. Another terminal of resistor R38 may be electrically connected to signal SUN-ISEN, a terminal of capacitor C34 and a positive terminal of diode D8. A negative terminal of diode D8 and another terminal of capacitor C34 may be connected to Ground.

A terminal of resistor R37 may be electrically connected to signal DATA, while another terminal of resistor R37 may be connected to Base terminal of transistor Q7. A collector terminal of transistor Q7 may be electrically connected to a terminal of resistor R36 and a second pin of power source J2. Another terminal of resistor R36 may be electrically connected to +3.6V voltage source. An emitter terminal of transistor Q7 and a first pin of power source J2 may be connected to the Ground.

Another terminal of capacitor C8 may be electrically connected to +3.6 voltage source, and a first pin of integrated chip U7. Another terminal of capacitor C8 may be electrically connected to a second pin of integrated chip U7. Signal ACOK may be electrically connected to a third pin of integrated chip U7. Signal LD1 may be electrically connected to a fourth pin of integrated chip U7. Signal LD2 may be electrically connected to a fifth pin of integrated chip U7. Signal LD3 may be electrically connected to a sixth pin of integrated chip U7. Signal LD4 may be electrically connected to a seventh pin of integrated chip U7. Signal IADP may be electrically connected to a tenth pin of integrated chip U7. Signal IDCHG may be electrically connected to an eleventh pin of integrated chip U7. Signal SUN-ISEN may be electrically connected to twelfth pin of integrated chip U7. Signal PRO may be electrically connected to thirteenth pin of integrated chip U7. Signal SDA may be electrically connected to fourteenth pin of integrated chip U7. Signal SCL may be electrically connected to fifteenth pin of integrated chip U7. Signal DATA may be electrically connected to sixteenth pin of integrated chip U7. A terminal of resistor R12 may be electrically connected to a ninth pin of integrated chip U7. A terminal of resistor R10, a terminal of capacitor C11, and another terminal of resistor R10 may be electrically connected to power source BAT. Another terminal of resistor R12 and another terminal of capacitor C11 may be connected to the Ground.

On the other hand, the +3.6V voltage source may be connected to a positive terminal of light emitting diode LLD3, a position terminal of light emitting diode LD4, a positive terminal of light emitting diode LD5, and a positive terminal of light emitting diode LD6. A negative terminal of light emitting diode LD3 may be electrically connected to a terminal of resistor R16, while another terminal of resistor R16 may be electrically connected to signal LD1. A negative terminal of light emitting diode LD4 may be electrically connected to a terminal of resistor R17, while another terminal of resistor R17 may be electrically connected to signal LD2. A negative terminal of light emitting diode LD5 may be electrically connected to a terminal of resistor R18, while another terminal of resistor R18 may be electrically connected to signal LD3. Resistor R19 may have one terminal electrically connected to light emitting diode LD6, and another terminal electrically connected to signal LD4. Resistor R21 may have one terminal electrically connected to voltage source VCC, and another terminal electrically connected to a negative terminal of diode D5, a second pin of integrated chip HT7536-1, and a terminal of capacitor C2. Another terminal of capacitor C2 may be connected to the Ground. A positive terminal of diode D5 may be electrically connected to voltage V-OUT.

A third pin of integrated chip HT7536-1 may be electrically connected to +3.6 v voltage source, and a terminal of capacitor C5. Another terminal of capacitor C5 may be connected to the Ground. A first pin of integrated chip HT7536-1 may also be connected to the Ground.

For the solar charging module 52, a first pin of integrated chip JP1 may be electrically connected to +5V voltage source. A second pin of integrated chip JP2 may be electrically connected to signal SWIM and signal U4-26. A third pin of integrated chip JP3 may be connected to the Ground. A terminal of resistor R2 may be electrically connected to +5V voltage source. Another terminal of resistor R2 may be electrically connected to a fourth pin of integrated chip JP1, a terminal of capacitor C1, and signal RST and signal U4-1. Another terminal of capacitor C1 may be connected to the Ground. A fifth pin of integrated chip JP1 may be electrically connected to signal T and a terminal of resistor R21. Another terminal of resistor R21 may be electrically connected to signal U4-30. A sixth pin of integrated chip JP1 may be electrically connected to signal R and a terminal of resistor R11. Another terminal of resistor R11 may be electrically connected to signal U4-31.

A first pin of integrated chip P1 may be electrically connected to signal U4-18. A second pin of integrated chip P1 may be electrically connected to signal U4-19. A third pin of integrated chip P1 may be electrically connected to signal U4-20. A fourth pin of integrated chip P1 may be electrically connected to signal U4-21. A fifth pin of integrated chip P1 may be electrically connected to signal U4-22. A sixth pin of integrated chip P1 may be electrically connected to signal U4-23. A seventh pin of integrated chip P1 may be electrically connected to signal U4-24. An eighth pin of integrated chip P1 may be electrically connected to signal U4-2. A ninth pin of integrated chip P1 may be electrically connected to signal U4-3. A tenth pin of integrated chip P1 may be electrically connected to signal U4-7, a third pin of a parallel connected resistors group RP2, and a fourth pin of a parallel connected resistors group RP2. An eleventh pin of integrated chip P1 may be electrically connected to signal U4-8, a first pin of a parallel connected resistors group RP2, and a second pin of a parallel connected resistors group RP2. A twelfth pin of integrated chip P1 may be electrically connected to signal U4-9, a third pin of a parallel connected resistors group RP1, and a fourth pin of a parallel connected resistors group RP1. A thirteenth pin of integrated chip P1 may be electrically connected to signal U4-10, a first pin of a parallel connected resistors group RP1, and a second pin of a parallel connected resistors group RP1.

A fifth pin, an eighth pin of the parallel connected resistors group RP1 and a fifth pin and an eighth pin of the parallel connected resistors group RP2 are connected to the Ground. A sixth pin and a seventh pin of the parallel connected resistors group RP1, and a sixth pin and a seventh pin of the parallel connected resistors group RP2 may be electrically connected to +5V voltage source.

A first pin of integrated chip U4 may be electrically connected to signal U4-1. A second pin of integrated chip U4 may be electrically connected to signal U4-2. A third pin of integrated chip U4 may be electrically connected to signal U4-3. A fourth pin of integrated chip U4 may be connected to the Ground. A fifth pin of integrated chip U4 may be electrically connected to a terminal of capacitor C17, while another terminal of capacitor C17 may be connected to the Ground. A sixth pin of integrated chip U4 may be electrically connected to +5V voltage source. A seventh pin of integrated chip U4 may be electrically connected signal U4-7. An eighth pin of integrated chip U4 may be electrically connected signal U4-8. A ninth pin of integrated chip U4 may be electrically connected signal U4-9. A tenth pin of integrated chip U4 may be electrically connected signal U4-10. An eleventh pin and a twelfth pin of integrated chip U4 are not connected. A thirteenth pin of integrated chip U4 may be electrically connected to a terminal of resistor R41, a terminal of resistor R39, and a terminal of capacitor C13. Another terminal of resistor R41 may be electrically connected to power source VA. A terminal of resistor R39 and another terminal of capacitor C13 may be connected to the Ground. A fourteenth pin of integrated chip U4 may be electrically connected to a terminal of capacitor C5, a terminal of resistor R19, and a terminal of variable resistor RT2. Another terminal of resistor R19 may be electrically connected to +5V voltage source. Another terminal of capacitor C5 and another terminal of variable resistor RT2 may be connected to the Ground. A fifteenth pin of integrated chip U4 may be electrically connected to signal U4-15. A sixteenth pin of integrated chip U4 may be electrically connected to signal U4-16. A seventeenth pin of integrated chip U4 may be electrically connected to a terminal of resistor R8 and a terminal of switch K3. Another terminal of resistor R8 may be electrically connected to +5V voltage source. An eighteenth pin of integrated chip U4 may be electrically connected to signal U4-18. A nineteenth pin of integrated chip U4 may be electrically connected to signal U4-19. A twentieth pin of integrated chip U4 may be electrically connected to signal U4-20. A twenty first pin of integrated chip U4 may be electrically connected to signal U4-21. A twenty second pin of integrated chip U4 may be electrically connected to signal U4-22. A twenty third pin of integrated chip U4 may be electrically connected to signal U4-23. A twenty fourth pin of integrated chip U4 may be electrically connected to signal U4-24. A twenty fifth pin of integrated chip U4 may be electrically connected to a terminal of resistor R30. Another terminal of resistor R30 may be electrically connected to +5V voltage source. A twenty sixth pin of integrated chip U4 may be electrically connected to a signal U4-26. A twenty seventh pin of integrated chip U4 may be electrically connected to a signal U4-27. A twenty eighth pin of integrated chip U4 may be electrically connected to a terminal of resistor R49 and a terminal of switch K1. Another terminal of resistor R29 may be electrically connected to +5V voltage source. A twenty ninth pin of integrated chip U4 may be electrically connected to a terminal of resistor R62 and a terminal of switch K2. Another terminal of resistor R62 may be electrically connected to +5V voltage source. Moreover, another terminal of switch K1, switch K2 and switch K3 may be connected to the Ground. A thirtieth pin of integrated chip U4 may be electrically connected to signal U4-30. A thirtieth first pin of integrated chip U4 may be electrically connected to signal U4-31. A thirtieth second pin of integrated chip U4 may be electrically connected to signal U4-32.

A terminal of resistor R46 may be electrically connected to signal U4-16, a terminal of resistor C12, and a terminal of resistor R40. Another terminal of resistor R46 and another terminal of capacitor C12 may be connected to the Ground. Another terminal of resistor R40 may be electrically connected to an output of operational amplifier U2B and a terminal of resistor R33. Another terminal of resistor R33 may be electrically connected to an inverting input of operational amplifier U2B and a terminal of resistor R29. Another terminal of resistor R29 may be connected to the Ground. A non-inverting input of operational amplifier U2B may be electrically connected to a positive terminal of diode D4, a terminal of capacitor C10, a terminal of resistor R22, and a terminal of resistor R27. A negative terminal of diode D4, another terminal of capacitor C10, another terminal of resistor R22, and another terminal of resistor R27 may be connected to the Ground. A terminal of resistor R37 may be electrically connected to signal U4-32 and a terminal of resistor R34. Another terminal of resistor R37 may be electrically connected to voltage source VB. Another terminal of resistor R34 may be electrically connected to a base terminal of transistor Q7. A collector terminal of transistor Q7 may be electrically connected to a terminal of resistor R42, and Gate terminal of MOSFET UA3. Another terminal of resistor R42 may be electrically connected to voltage source VB. A drain terminal of MOSFET UA3 may be connected to the Ground. A source terminal of MOSFET UA3 and an emitter terminal of transistor Q7 may be connected to the Ground. A positive terminal of diode D1 may be electrically connected to voltage source VA. A negative terminal of diode D1 may be electrically connected to a terminal of resistor R1, a terminal of resistor R3, and a collector terminal of transistor Q1. Another terminal of resistor R1 may be electrically connected to another terminal of resistor R3, a base terminal of transistor Q1 and a negative terminal of Zener diode ZD1. A positive terminal of Zener diode ZD1 may be connected to the Ground. An emitter terminal of transistor Q1 may be electrically connected to a positive terminal of electrolytic capacitor C4, a terminal of capacitor C11, a voltage source VB, a terminal of resistor R12, and a collector terminal of transistor Q5. A negative terminal of electrolytic capacitor C4 and another terminal of capacitor C11 may be connected to the Ground.

Another terminal of resistor R12 may be electrically connected to a base terminal of transistor Q5, a negative terminal of Zener diode U1, a terminal of resistor R15, and a terminal of resistor R16. A positive terminal of Zener diode U1 and another terminal of resistor R16 may be connected to the Ground. Another terminal of resistor R15 may be electrically connected to an emitter terminal of transistor Q5, a positive terminal of electrolytic capacitor C6, a terminal of capacitor C7, a terminal of capacitor C8, and a +5V voltage source. A negative terminal of electrolytic capacitor C6, another terminal of capacitor C7, and another terminal of capacitor C8 may be connected to the Ground. A positive terminal of diode D5 may be electrically connected to voltage source VA and voltage source TP1. A negative terminal of diode D5 may be electrically connected to a positive terminal of electrolytic capacitor C2, a positive terminal of electrolytic capacitor C3, and a first pin of integrated chip U3.

A fourth pin of integrated chip U3 may be disconnected. A second pin of integrated chip U3 may be electrically connected to a terminal of inductor L1 and a negative terminal of diode D6. Another terminal of inductor L1 may be electrically connected to a third pin of integrated chip U3, a positive terminal of electrolytic capacitor C14, a terminal of resistor R55, a terminal of resistor R53, a first pin of integrated chip USB, an eighth pin of integrated chip USB, and voltage source USB_+5V. Another terminal of resistor R55 may be electrically connected to a terminal of resistor R56, a second pin of integrated chip USB and a seventh pin of integrated chip USB. Another terminal of resistor R53 may be electrically connected to a terminal of resistor R52, a third pin of integrated chip USB and a sixth pin of integrated chip USB.

A negative terminal of electrolytic capacitor C2, a negative terminal of electrolytic capacitor C3, a fifth pin of integrated chip U3, a sixth pin of integrated chip U3, a seventh pin of integrated chip U3, an eighth pin of integrated chip U3, a positive terminal of diode D6, a negative terminal of electrolytic capacitor C14, another terminal of resistor R56, another terminal of resistor R52, a fourth pin of integrated chip USB and a fifth pin of integrated chip USB are connected to the Ground.

A terminal of resistor R28 may be electrically connected to signal U4-15. Another terminal of resistor R28 may be electrically connected to a terminal of resistor R26, a terminal of resistor R25, a terminal of capacitor C9, and a terminal of resistor R23. Another terminal of resistor R26 may be electrically connected to +5V voltage source. Another terminal of resistor R25 and another terminal of capacitor C9 may be connected to the Ground. Another terminal of resistor R23 may be electrically connected to a terminal of resistor R9, a terminal of resistor R47, a collector terminal of transistor Q3, a terminal of variable resistor MOV1, a positive terminal of Zener diode ZD2, a terminal of resistor R4, a Source terminal of MOSFET UA1, and a second pin of integrated chip COM1.

Another terminal of resistor R9 may be electrically connected to a terminal of resistor R7, a terminal of resistor R13, a positive terminal of diode D3, and a base terminal of transistor Q3. A negative terminal of diode D3 may be electrically connected to an emitter terminal of transistor Q3, a negative terminal of Zener diode ZD2, and a gate terminal of MOSFET UA1. Another terminal of resistor R7 may be electrically connected to another terminal of resistor R13 and a collector terminal of transistor Q2.

A positive terminal of diode D2 may be electrically connected to voltage source VA. A negative terminal of diode D2 may be electrically connected to an emitter terminal of transistor Q2 and a terminal of resistor R10. Another terminal of resistor R10 may be electrically connected to a terminal of resistor R14 and a base terminal of resistor Q2. Another terminal of resistor R14 may be electrically connected to a collector terminal of transistor Q4. A gate terminal of transistor Q4 may be electrically connected to a terminal of resistor R17 and a terminal of resistor R18. Another terminal of resistor R18 may be electrically connected to signal U4-27. Another terminal of resistor R17 and an emitter terminal of transistor Q4 may be connected to the Ground.

A first pin of integrated chip COM1, a third pin of integrated chip COM1, and a fifth pin of integrated chip COM1 may be electrically connected to voltage source VA. A fourth pin of integrated chip COM1 and a sixth pin of integrated chip COM1 may be connected to the Ground.

A drain terminal of MOSFET UA1 may be electrically connected to a drain terminal of MOSFET UA2. A source terminal of MOSFET UA2 and a terminal of resistor R24 may be connected to the Ground. A gate terminal of MOSFET UA2 may be electrically connected to another terminal of resistor R24, and a terminal of resistor R20. Another terminal of resistor R20 may be electrically connected to an output of operational amplifier U2A. A positive power input of the operational amplifier U2A may be electrically connected to voltage source VB. A negative power input of operational amplifier U2A may be connected to the Ground. An inverting input of operational amplifier U2A may be electrically connected to another terminal of resistor R47, a terminal of resistor R44, and a terminal of resistor R45. Another terminal of resistor R44 may be electrically connected to +5V voltage source. Another terminal of resistor R45 may be connected to the Ground. A non-inverting input of operational amplifier U2A may be electrically connected to a terminal of resistor R38 and a terminal of resistor R35. Another terminal of resistor R38 may be electrically connected to +5V voltage source. Another terminal of resistor R35 may be electrically connected to a terminal of resistor R36. Another terminal of resistor R36 may be connected to the Ground.

The charging control module 51 may be arranged to control and manage charging of the rechargeable battery pack 40. For example, when an input voltage is 12V or 24V, the integrated chip HT7536-1, integrated chip U3, integrated chip U4 and integrated chip U7 may be configured to discharge and charge the rechargeable battery pack 40 by using 6 A current. The integrated chip HT7536-1, integrated chip U3, integrated chip U4 and integrated chip U7 may also be configured to protect overcharging, over-discharging or prevent short circuit of the rechargeable battery pack 40. Moreover, the integrated chip HT7536-1, integrated chip U3, integrated chip U4 and integrated chip U7 may also be configured to protect the battery of the vehicle when the present invention is electrically connected to the vehicle's rechargeable battery.

The solar charging module 52 may be configured to control and manage charging of the solar battery 62 by employing maximum voltage of 55V and charging current of 10 A. Integrated chip JP1, integrated chip P1, integrated chip U4, integrated chip U3, integrated chip USB and integrated chip COM1 may be configured and programmed to manage Pulse Width Modulation (PMW) charging cycles.

On the other hand, Zener diode ZD1, Zener diode ZD2, Zener diode U1, transistor Q1, transistor Q2, transistor Q3, transistor Q4, transistor Q5 and transistor Q7 may be utilized to prevent current overflow and short circuit so as to accomplish open circuit protection and reverse protection. MOSFET UA1, MOSEFT UA2, MOSFET UA3, resistors group RP1 and resistors group RP2 may be utilized to create a backflow prevention circuit.

The energy management module 53 may be configured to allocate the optimal voltage to the compressor 32. The central control unit 50 may be configured to accomplish uninterruptible power supply (UPS) so that it provides near-instantaneous protection from input power interruptions to the compressor 32 and other components of the cooling mechanism 30. According to the preferred embodiment of the present invention, the preferred mode of power supply is through an external DC power input. An adapter may be utilized to convert an external AC power supply into a DC power supply. When both an external DC power input and the rechargeable battery pack 40 are connected to the portable refrigerator, the central control unit 50 may first allocate the power from the external DC power supply to operate the compressor 32 and other components of the portable refrigerator. When the rechargeable battery pack 40 needs recharging, the central control unit 50 may be configured to allocate an optimal amount of power to recharge the rechargeable battery pack 40 and at the same time to keep operating the compressor 32.

Thus, the charging control module 51, the solar charging module 52 and the energy management module 53 may allocate an optimal amount of electrical power to the cooling mechanism 30 and the rechargeable battery pack 40. The cooling mechanism 30 may have a priority in allocation of electrical power. When the rechargeable battery pack 40 has insufficient battery level or power, the central control unit 50 may command charging of the rechargeable battery pack 40.

Moreover, when the rechargeable battery pack 40 is not connected to the central control unit 50, the portable refrigerator may also be powered by connecting it to an external power supply, such as an external DC power supply typically found in a vehicle, or the solar panel 62.

The present invention, while illustrated and described in terms of a preferred embodiment and several alternatives, is not limited to the particular description contained in this specification. Additional alternative or equivalent components could also be used to practice the present invention.

What is claimed is:

1. A portable refrigerator, comprising:

a main housing having an accommodating cavity for storing at least one item, and a power compartment;

a refrigerator cover provided on said main housing for selectively closing said accommodating cavity;

a cooling mechanism which is supported by said main housing and comprises a plurality of heat exchanging tubes, a compressor, an evaporator connected to said compressor through at least one of said heat exchanging tubes, and a condenser connected to said evaporator and said compressor through at least one of said heat exchanging tubes;

a rechargeable battery pack detachably attached on said power compartment of said main housing, said rechargeable battery pack being adapted for connecting to a power source; and a central control unit supported in said main housing and electrically connected to said rechargeable battery pack and said cooling mechanism for centrally controlling an operation of said cooling mechanism, wherein a predetermined amount of refrigerant is arranged to controllably pass through said heat exchanging tubes, said condenser, said evaporator and said compressor for extracting heat from said accommodating cavity, wherein said central control unit comprises a charging control module, and a solar charging module electrically connected to said charging control module, said central control unit being configured to provide uninterruptible power supply so as to provide instantaneous protection from input power interruption to said cooling mechanism.

2. A portable refrigerator, comprising:

a main housing having an accommodating cavity for storing at least one item, and a power compartment;

a refrigerator cover provided on said main housing for selectively closing said accommodating cavity;

a cooling mechanism which is supported by said main housing and comprises a plurality of heat exchanging tubes, a compressor, an evaporator connected to said compressor through at least one of said heat exchanging tubes, and a condenser connected to said evaporator and said compressor through at least one of said heat exchanging tubes;

a rechargeable battery pack detachably attached on said power compartment of said main housing, said rechargeable battery pack being adapted for connecting to a power source, and comprising a battery housing and a battery core received in said battery housing, said battery housing having a front battery surface, a rear battery surface, two side battery surfaces, a top battery surface and a bottom battery surface, said rechargeable battery pack further comprising a locking arrangement operatively provided on said battery housing for allowing said battery housing to be selectively locked and detached from said power compartment; and a central control unit supported in said main housing and electrically connected to said rechargeable battery pack and said cooling mechanism for centrally controlling an operation of said cooling mechanism, wherein a predetermined amount of refrigerant is arranged to controllably pass through said heat exchanging tubes, said condenser, said evaporator and said compressor for extracting heat from said accommodating cavity, wherein said central control unit comprises a charging control module, and a solar charging module electrically connected to said charging control module, said central control unit being configured to provide uninterruptible power supply so as to provide instantaneous protection from input power interruption to said cooling mechanism.

3. A portable refrigerator, comprising:

a main housing having an accommodating cavity for storing at least one item, and a power compartment;

a refrigerator cover provided on said main housing for selectively closing said accommodating cavity;

a cooling mechanism which is supported by said main housing and comprises a plurality of heat exchanging tubes, a compressor, an evaporator connected to said compressor through at least one of said heat exchanging tubes, and a condenser connected to said evaporator and said compressor through at least one of said heat exchanging tubes;

a rechargeable battery pack detachably attached on said power compartment of said main housing, said rechargeable battery pack being adapted for connecting to a power source, and comprising a battery housing and a battery core received in said battery housing, said battery housing having a front battery surface, a rear battery surface, two side battery surfaces, a top battery surface and a bottom battery surface, said rechargeable battery pack further comprising a locking arrangement operatively provided on said battery housing for allowing said battery housing to be selectively locked and detached from said power compartment; and a central control unit supported in said main housing and electrically connected to said rechargeable battery pack and said cooling mechanism for centrally controlling an operation of said cooling mechanism, wherein a predetermined amount of refrigerant is arranged to controllably pass through said heat exchanging tubes, said condenser, said evaporator and said compressor for extracting heat from said accommodating cavity, wherein said central control unit comprises a charging control module, and a solar charging module electrically connected to said charging control module, said central control unit being configured to provide uninterruptible power supply so as to provide instantaneous protection from input power interruption to said cooling mechanism, said locking arrangement comprising a first actuating member, and a first resilient element mounted on said first actuating member to normally exert a biasing force thereto, said locking arrangement further containing a plurality of through passage holes formed on said battery housing, said first actuating member being arranged to selectively and partially pass through said corresponding through passage holes, said first actuating member having a first locking latch, a second locking latch, and a first depressing member positioned between said first locking latch and said second locking latch, said first resilient elements being arranged to normally exert a biasing force against said first actuating member so as to drive said first locking latch, said second locking latch and said first depressing member to normally expose out of said battery housing through said corresponding through passage holes.

* * * * *